US012747584B1

(12) United States Patent
Fieramosca

(10) Patent No.: US 12,747,584 B1
(45) Date of Patent: Sep. 29, 2026

(54) WALL ASSEMBLY

(71) Applicant: Edward Fieramosca, Las Vegas, NV (US)

(72) Inventor: Edward Fieramosca, Las Vegas, NV (US)

( * ) Notice: Subject to any disclaimer, the term of this patent is extended or adjusted under 35 U.S.C. 154(b) by 263 days.

(21) Appl. No.: 18/601,056

(22) Filed: Mar. 11, 2024

Related U.S. Application Data

(60) Provisional application No. 63/452,195, filed on Mar. 15, 2023.

(51) Int. Cl.
*E04B 2/72* (2006.01)

(52) U.S. Cl.
CPC ..... *E04B 2/721* (2013.01)

(58) Field of Classification Search
CPC ..... E04B 1/61; E04B 1/343; E04B 1/34321; E04B 1/34352; E04B 1/388; E04B 1/48; E04B 1/6116; E04B 2001/386; E04B 2001/6195
USPC ..... 52/DIG. 4
See application file for complete search history.

(56) References Cited

U.S. PATENT DOCUMENTS 4,299,067 A * 11/1981 Bertschi ..... E04B 2/7401 52/285.4
5,609,003 A * 3/1997 Jouty ..... E04B 1/34321 52/285.4
9,200,447 B1 * 12/2015 Bargh ..... E04C 5/12
10,264,882 B1 * 4/2019 Lai ..... A47B 96/04
2007/0094963 A1 * 5/2007 McDonald ..... E04B 5/10 52/270
2009/0282759 A1 * 11/2009 Porter ..... E04B 2/7457 52/220.1
2011/0047912 A1 * 3/2011 Armijo ..... E04B 1/14 52/309.4
2013/0019541 A1 * 1/2013 Lin ..... E04B 1/34321 52/580

(Continued)

FOREIGN PATENT DOCUMENTS

CA 2280077 A1 * 2/2000 ..... E04C 2/296
CN 211974187 U * 11/2020

(Continued)

OTHER PUBLICATIONS

Machine Translation of CN211974187 (Year: 2020).*

*Primary Examiner* — Ryan D Kwiecinski
(74) *Attorney, Agent, or Firm* — Bayramoglu Law Offices LLC

(57) ABSTRACT

A wall assembly includes first and second wall members and first and second base members. The first wall member has a side male coupling portion, a side female coupling portion, a bottom female coupling portion, and a magnet. The first base member has a base plate and a male coupling portion extending upwardly therefrom. The bottom female coupling portion of the first wall member receives the male coupling portion of the first base member therein. The second wall member has a side male coupling portion, a side female coupling portion, a bottom female coupling portion, and a magnet. The second base member has a base plate and a male coupling portion extending upwardly therefrom. The bottom female coupling portion of the second wall member receives the male coupling portion of the second base member therein.

11 Claims, 31 Drawing Sheets

(56) References Cited

U.S. PATENT DOCUMENTS

| | | | | |
|---|---|---|---|---|
| 2013/0042556 | A1* | 2/2013 | Armijo | E04B 5/023 52/309.4 |
| 2015/0300008 | A1* | 10/2015 | Gosling | E04C 2/46 52/506.05 |
| 2017/0065902 | A1* | 3/2017 | Maxam | E04C 2/36 |
| 2017/0306610 | A1* | 10/2017 | Leahy | E04B 1/74 |
| 2018/0305924 | A1* | 10/2018 | Buffington | E04B 2/7405 |
| 2018/0334798 | A1* | 11/2018 | Fay | E04C 2/46 |
| 2020/0217067 | A1* | 7/2020 | Rosan | E04B 2/721 |
| 2020/0354945 | A1* | 11/2020 | Morrow | E04B 1/24 |
| 2021/0401177 | A1* | 12/2021 | DeZaio | E04B 2/72 |
| 2023/0167636 | A1* | 6/2023 | Keller | E04B 1/14 52/91.3 |
| 2024/0060286 | A1* | 2/2024 | Collingwood | E04B 1/34846 |

FOREIGN PATENT DOCUMENTS

| | | | | |
|---|---|---|---|---|
| GB | 2442959 | A * | 4/2008 | E04B 1/21 |
| WO | WO-9106724 | A1 * | 5/1991 | E04B 2/721 |
| WO | WO-2011026046 | A1 * | 3/2011 | E04B 5/026 |

* cited by examiner

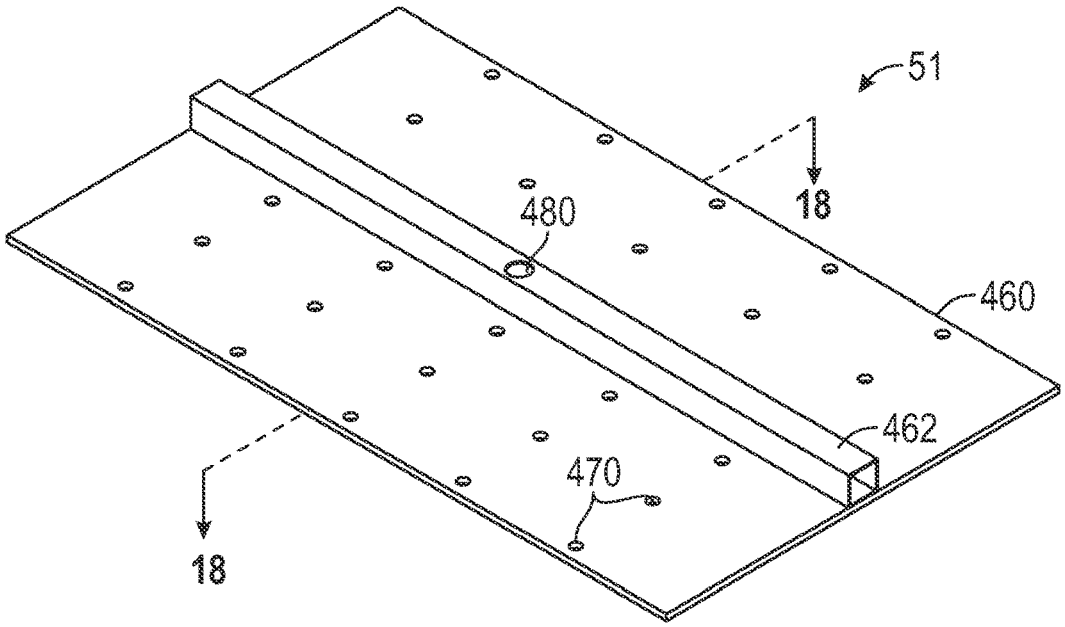
FIG. 17
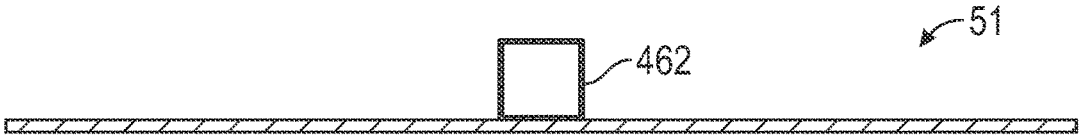
FIG. 18
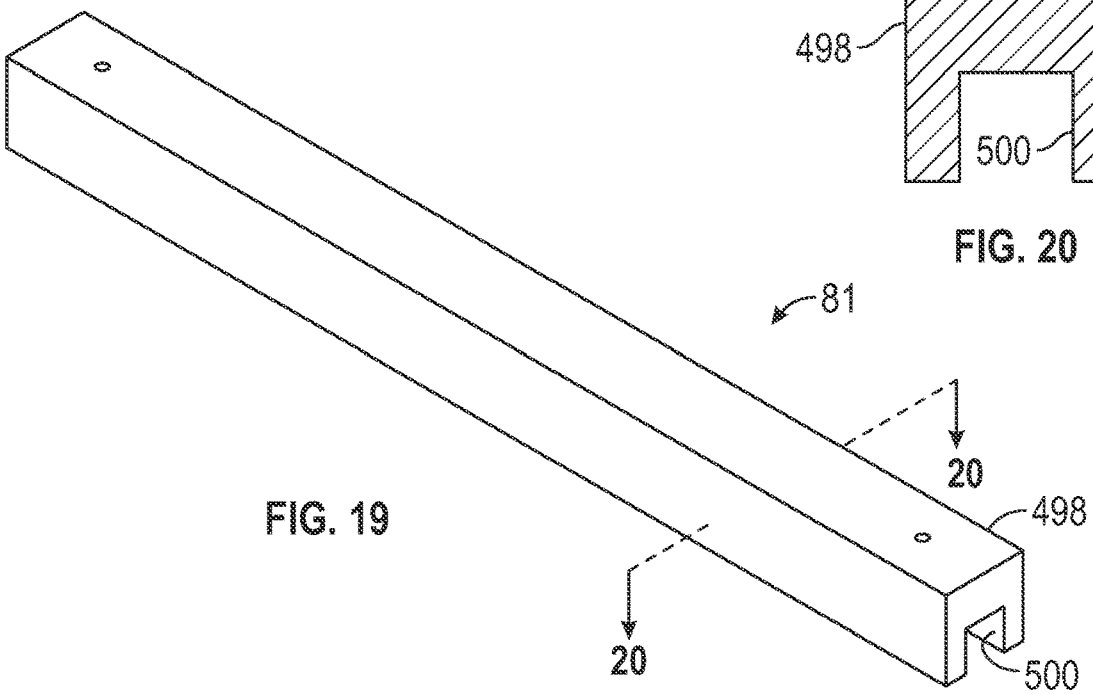
FIG. 20
FIG. 19

WALL ASSEMBLY

CROSS-REFERENCE TO RELATED APPLICATIONS

This application claims priority to U.S. Provisional Patent Application No. 63/452,195 filed on Mar. 15, 2023, the entire contents of which are hereby incorporated by reference herein.

BACKGROUND

Wall systems have been developed. However, it is often difficult to maintain the alignment of wall sections when two wall sections are being coupled together. Further, the wall sections don't have both electric arc resistance vertical and horizontal internal support bars extending within the wall sections to provide additional support for attaching relatively heavy objects and internal electrical conduit to the wall sections.

The inventor herein has recognized the need for improved wall assembly that minimizes and/or eliminates the above-mentioned deficiencies.

SUMMARY

A wall assembly in accordance with an exemplary embodiment is provided. The wall assembly includes a first wall member having a side male coupling portion, a side female coupling portion, a bottom female coupling portion, and a first magnet. The side male coupling portion and the side female coupling portion of the first wall member extend parallel to one another. The first magnet of the first wall member is disposed in the side male coupling portion of the first wall member. The wall assembly further includes a first base member having a base plate and a male coupling portion coupled to and extending upwardly from the base plate thereof. The bottom female coupling portion of the first wall member receives the male coupling portion of the first base member therein such that the first wall member is removably coupled to the first base member. The wall assembly further includes a second wall member having a side male coupling portion, a side female coupling portion, a bottom female coupling portion, and a first magnet. The side male coupling portion and the side female coupling portion of the second wall member extend parallel to one another. The first magnet of the second wall member is disposed in the side female coupling portion of the second wall member. The wall assembly further includes a second base member having a base plate and a male coupling portion coupled to and extending upwardly from the base plate thereof. The bottom female coupling portion of the second wall member receives the male coupling portion of the second base member therein such that the second wall member is removably coupled to the second base member. The side male coupling portion of the first wall member is received in the side female coupling portion of the second wall member such that the first magnet in the first wall member is magnetically attracted toward the first magnet in the second wall member and the first wall member is removably coupled to the second wall member.

BRIEF DESCRIPTION OF THE DRAWINGS

FIG. 17 is an isometric view of a first base member utilized in the wall assembly of FIG. 1;

FIG. 18 is a cross-sectional view of the first base member of FIG. 17 taken along lines 18-18 in FIG. 17;

FIG. 19 is an isometric view of a top cap member utilized in the wall assembly of FIG. 1;

FIG. 20 is a cross-sectional view of the top cap member of FIG. 19 taken along lines 20-20 in FIG. 19;

DETAILED DESCRIPTION

Figure 1:
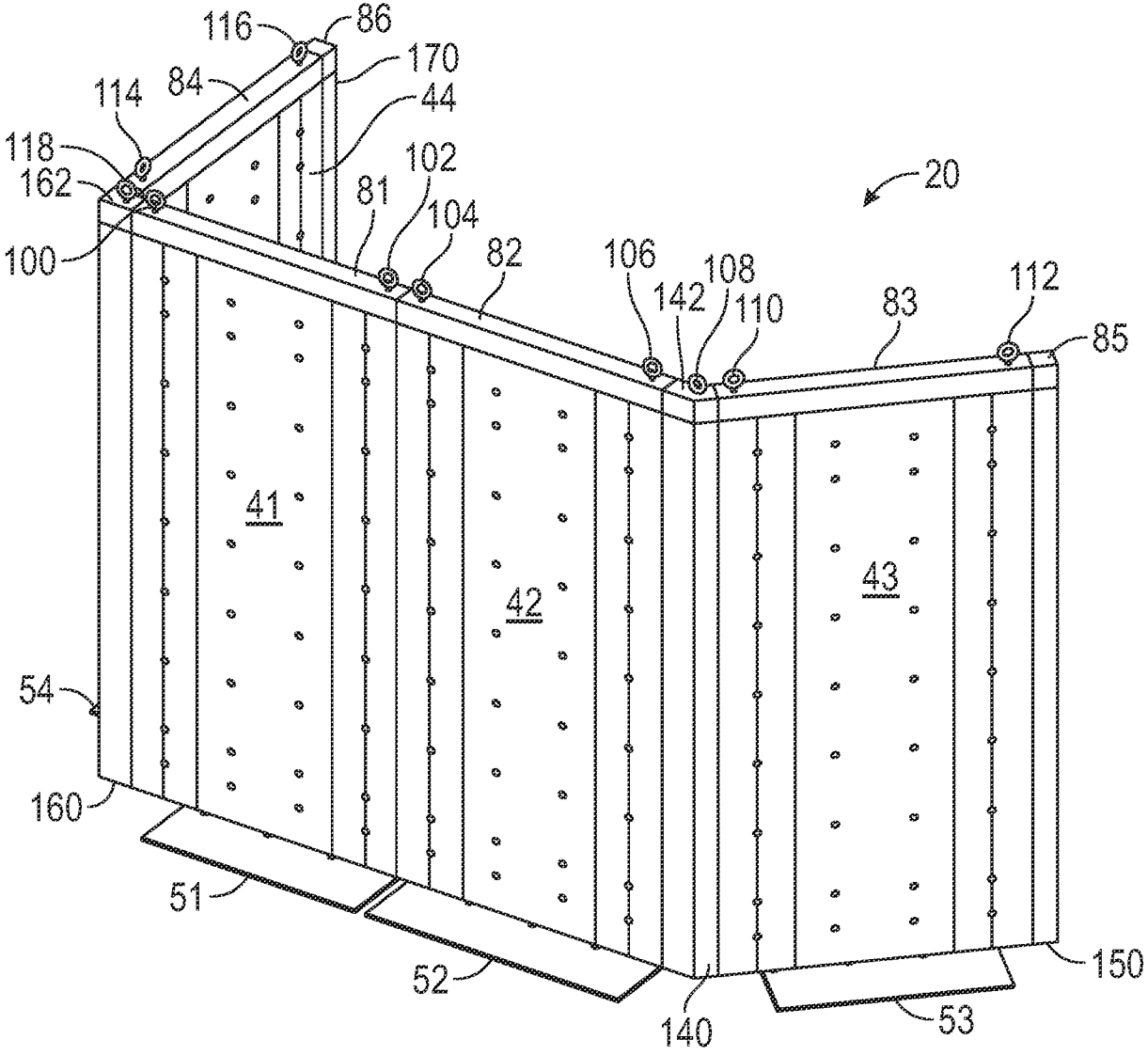
FIG. 1 is an isometric view of a wall assembly in accordance with an exemplary embodiment.
Figure 2:
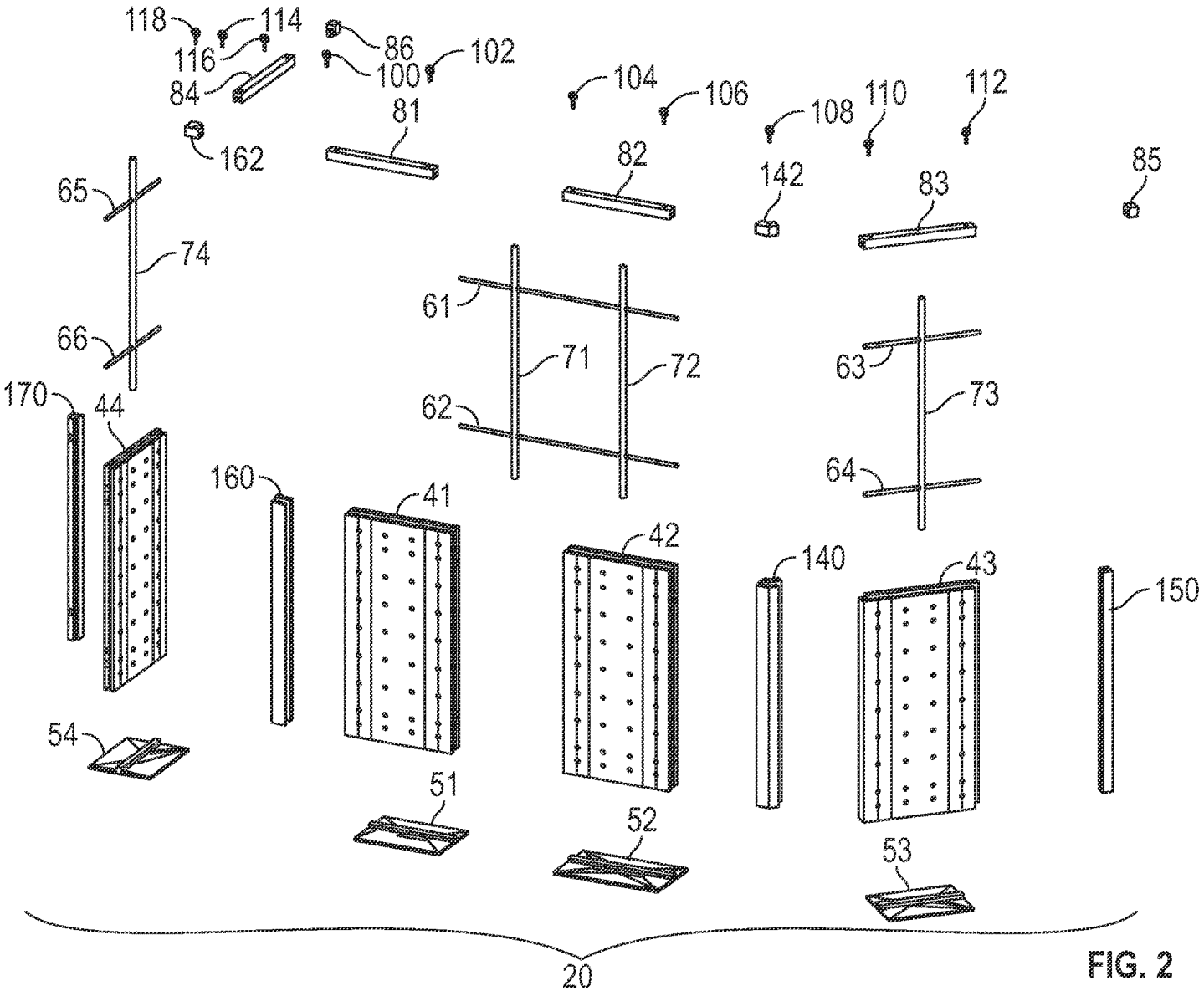
FIG. 2 is an exploded view of the wall assembly of FIG. 1.
Figure 3:
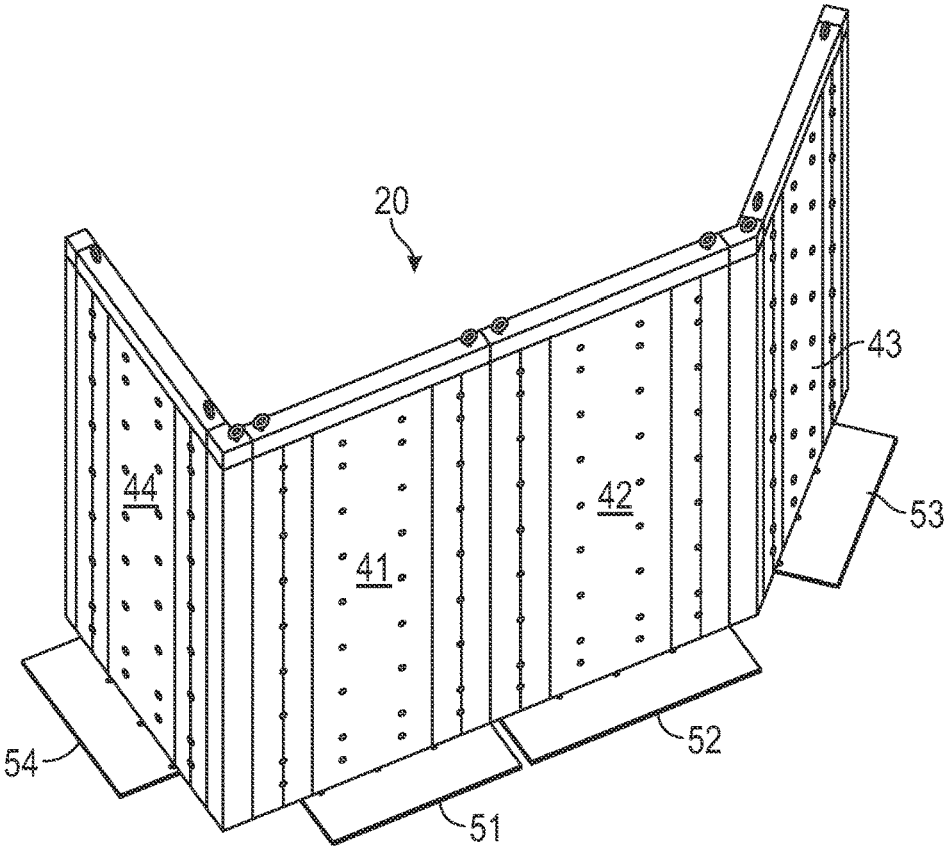
FIG. 3 is another isometric view of the wall assembly of FIG. 1.
Figure 4:
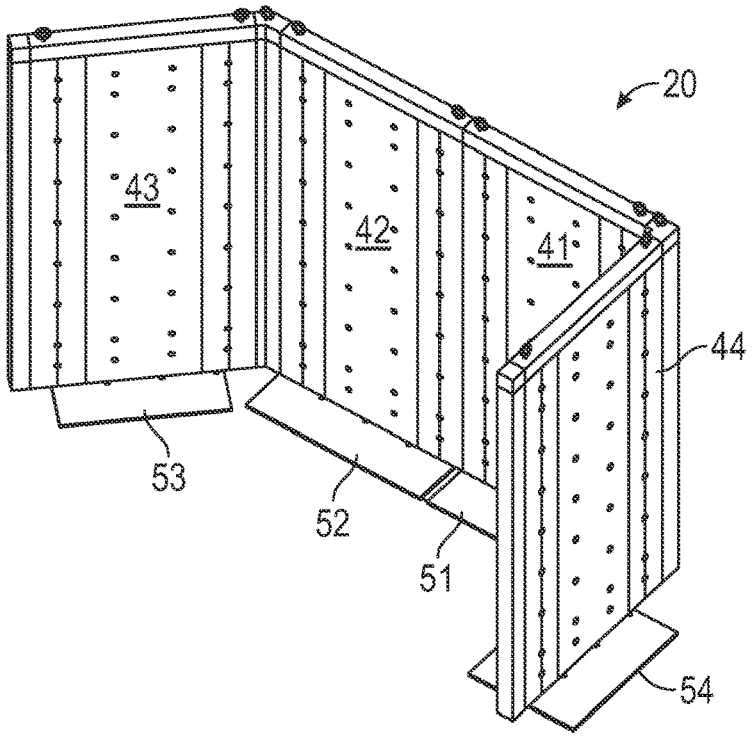
FIG. 4 is another isometric view of the wall assembly of FIG. 1.
Figure 5:
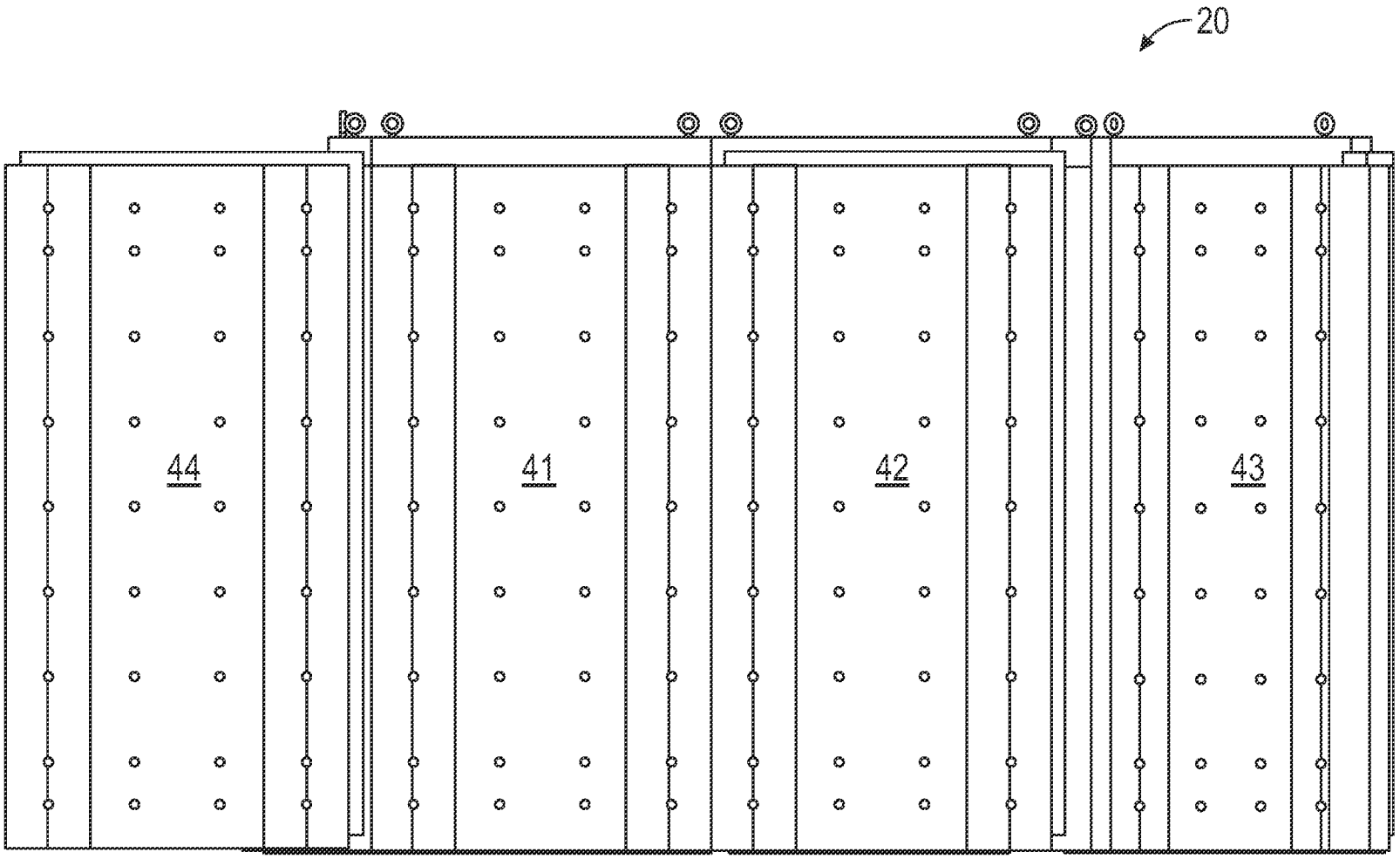
FIG. 5 is a front view of the wall assembly of FIG. 1.
Figure 6:
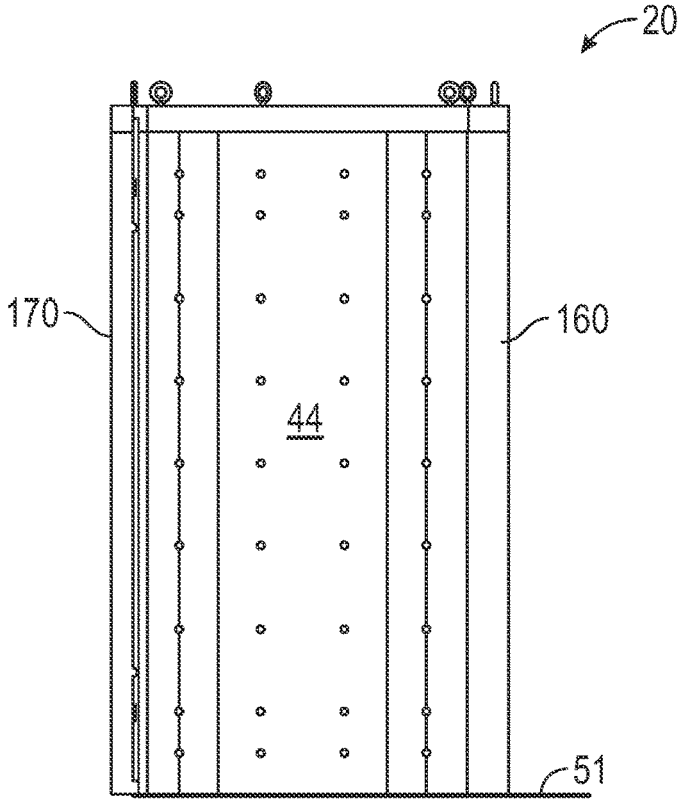
FIG. 6 is a side view of the wall assembly of FIG. 1.
Figure 7:
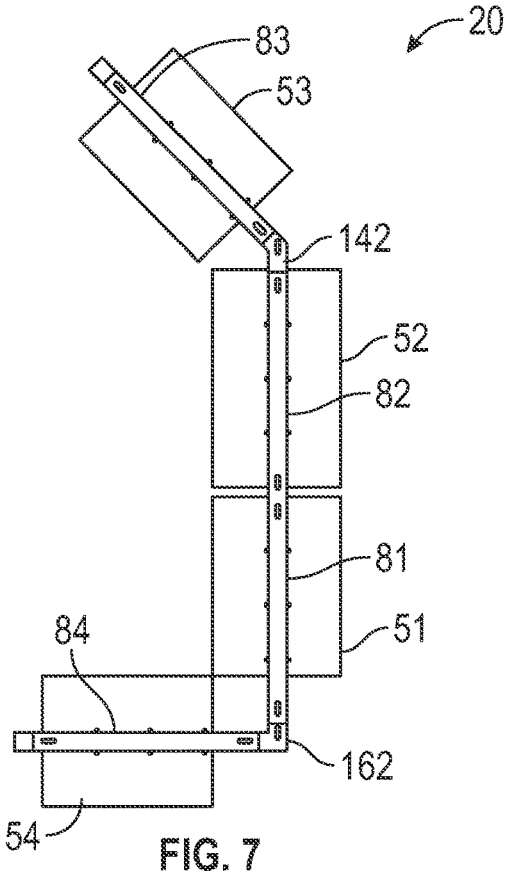
FIG. 7 is a top view of the wall assembly of FIG. 1.

Referring to FIGS. 1-7, a wall assembly 20 in accordance with an exemplary embodiment is illustrated. The wall assembly 20 includes first, second, third, and fourth wall members 41, 42, 43, 44, first, second, third, and fourth base members 51, 52, 53, 54, support bars 61, 62, 63, 64, 65, 66, support bars 71, 72, 73, 74, first, second, third, fourth top cap members 81, 82, 83, 84, 85, 86, eye bolts 100, 102, 104, 106, 108, 110, 112, 114, 116, 118, a corner coupling member 140, a corner cap member 142, an end cap member 150, a corner coupling member 160, a corner cap member 162, and an end cap member 170.

An advantage of the wall assembly 20 is that the assembly 20 utilizes the wall members having male coupling portions and female coupling portions having magnets therein for aligning and holding the wall members together during installation. Further, the wall assembly 20 utilizes base members with male coupling portions for aligning and holding the wall members thereon during installation.

First Wall Member

Referring to FIGS. 1, 2 and 8-16, the first wall member 41 is provided to be coupled to the second wall member 42, the first base member 51, the top cap member 81, and the corner coupling member 160. The first wall member 41 includes a central sheet portion 200, side sheet portions 211, 212, 213, side sheet portions 221, 222, 223, receiving openings 241, 242, 251, 252, attachment boards 261, 262, 271, 272, and magnets 291, 292, 301, 302, 311, 312, 321, 322.

Referring to FIGS. 13-16, the central sheet portion 200 is substantially rectangular-shaped. The central sheet portion 200 has a first side integrally formed with the side sheet portions 211, 212, 213. The central sheet portion 200 has a second side integrally formed with the side sheet portions 221, 222, 223. The central sheet portion includes a vertical aperture 340 (shown in FIG. 16) and horizontal apertures 351, 352 extending therethrough. The horizontal apertures 351, 352 extend substantially perpendicular to the vertical aperture 340. The vertical aperture 340 is provided to receive the support bar 71 (shown in FIG. 15) therein. The horizontal aperture 351 is provided to receive the support rod 61 (shown in FIG. 15) therein. Also, the horizontal aperture 352 is provided to receive the support rod 62 therein.

Figure 10:
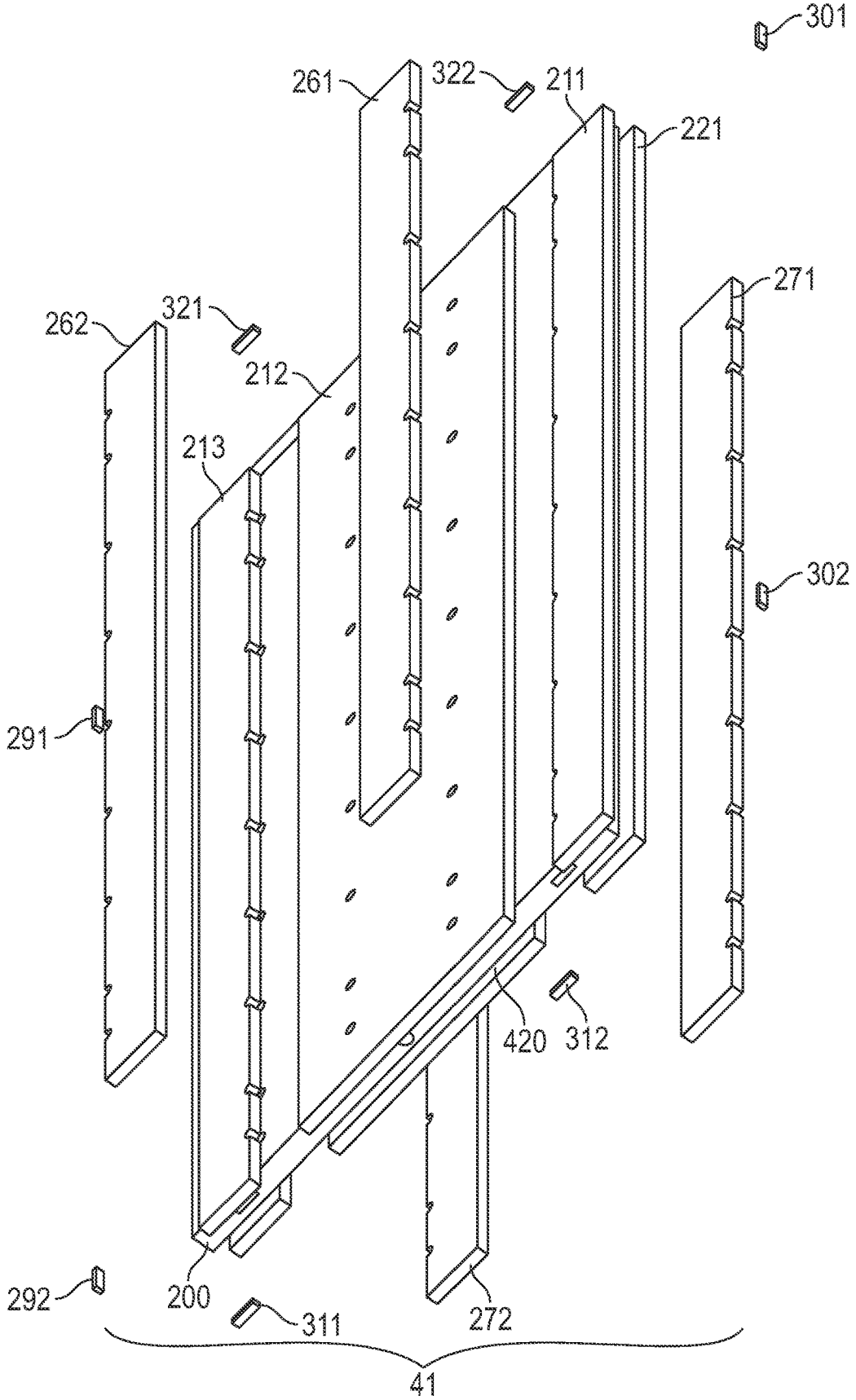
FIG. 10 is an exploded view of the first wall member of FIG. 8.
Figure 11:
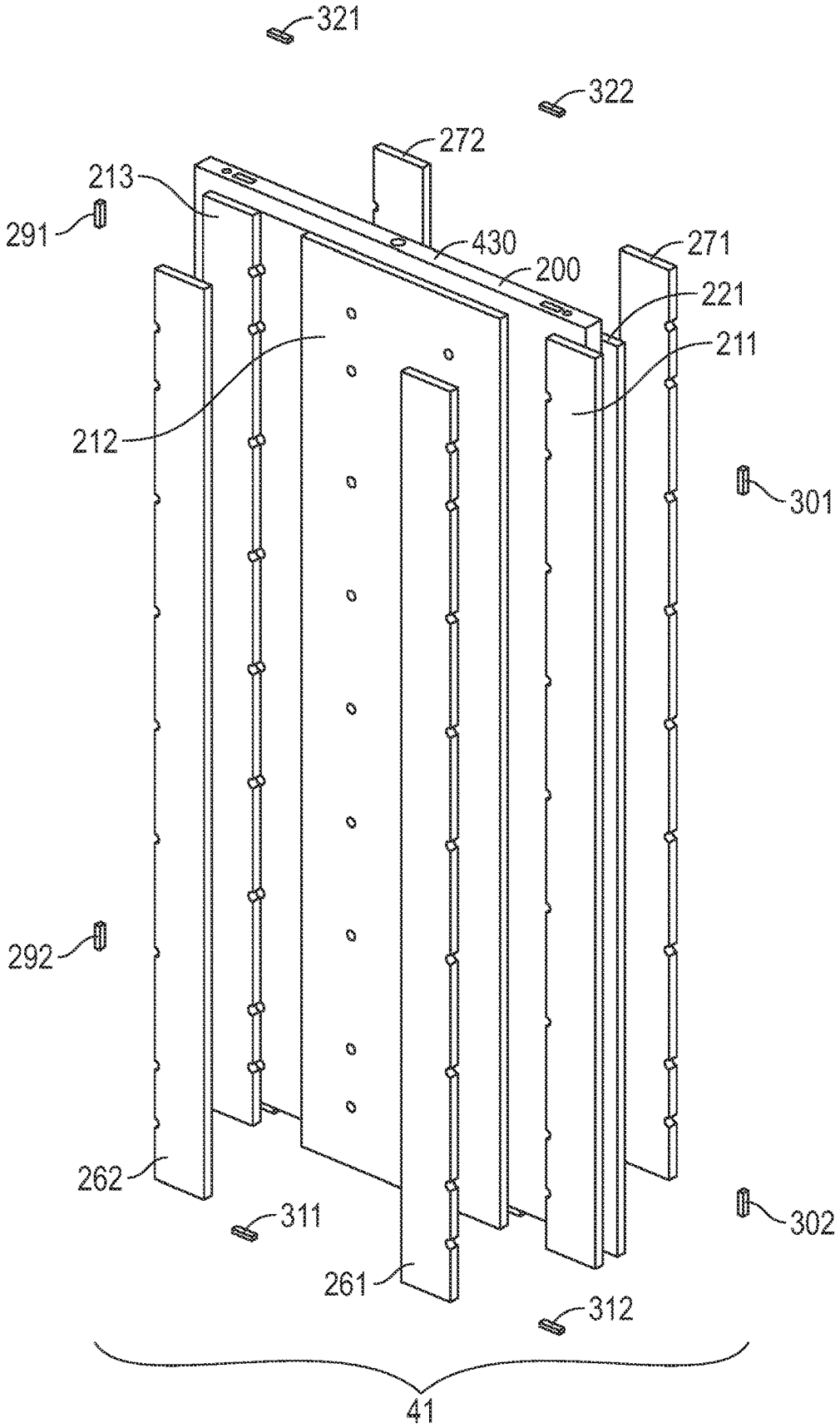
FIG. 11 is another exploded view of the first wall member of FIG. 8.
Figure 12:
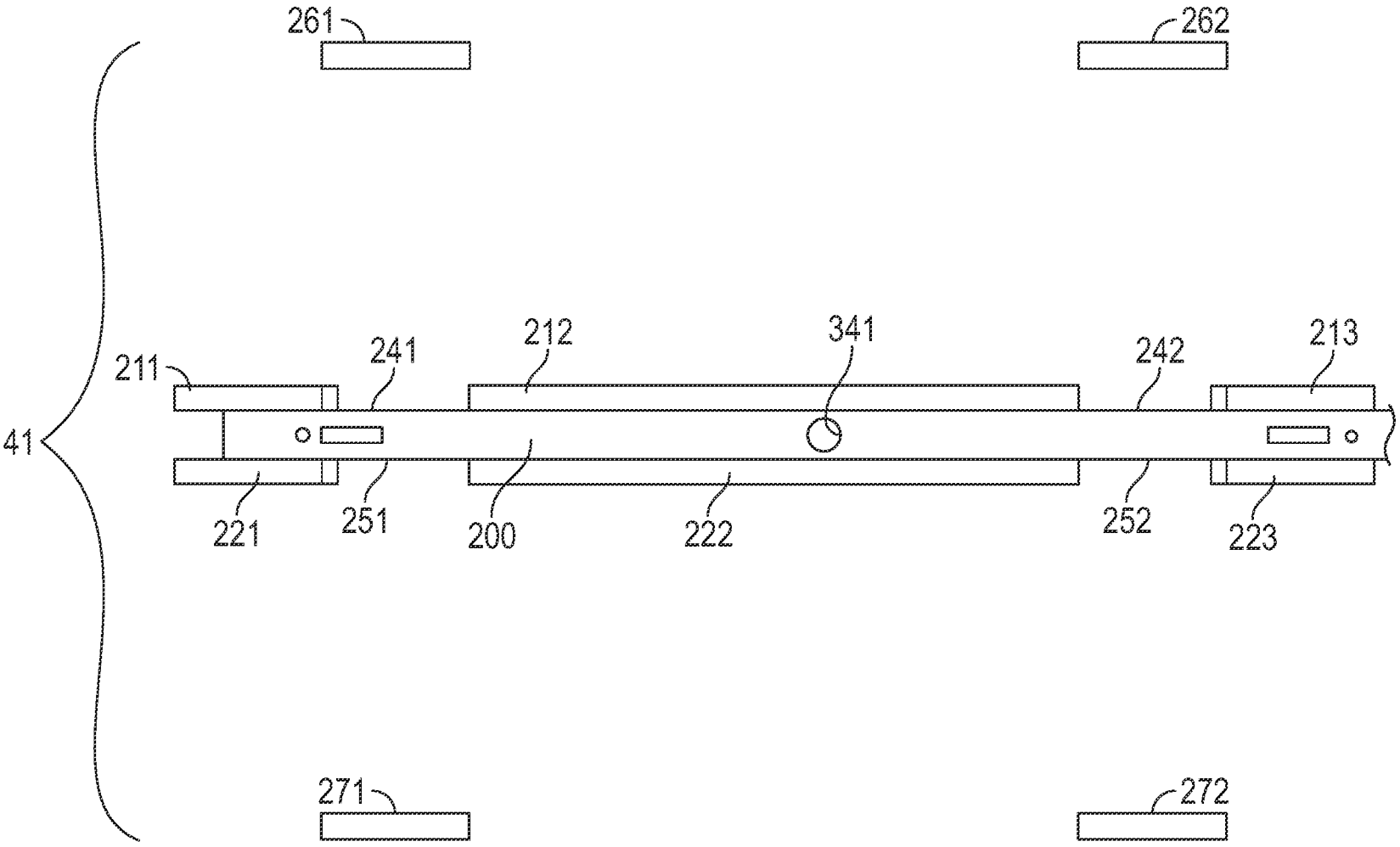
FIG. 12 is a partial exploded view of the first wall member of FIG. 8.
Figure 13:
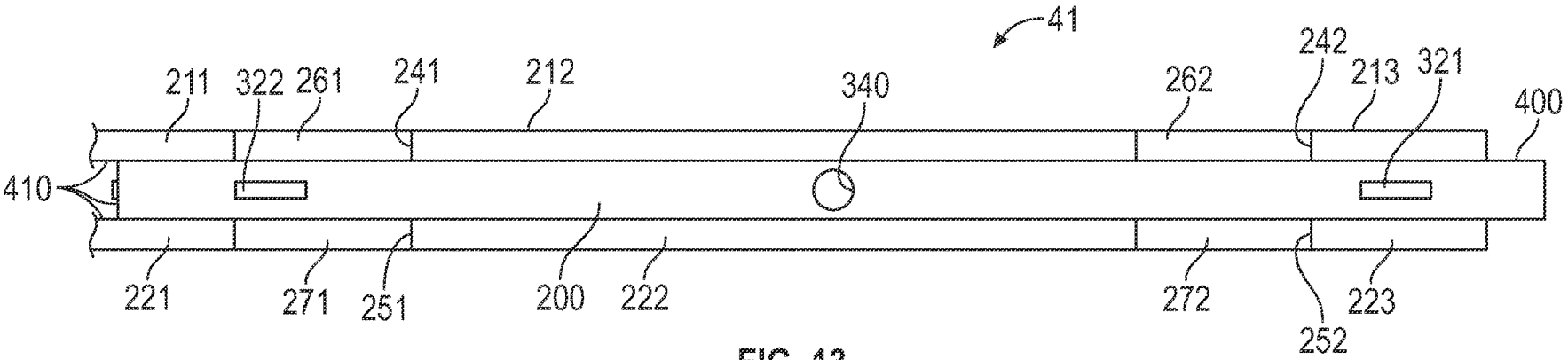
FIG. 13 is a top view of the first wall member of FIG. 8.
Figure 14:
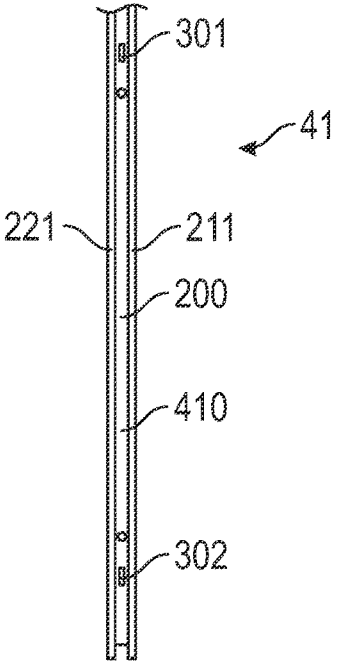
FIG. 14 is a side view of the first wall member of FIG. 8.
Figure 16:
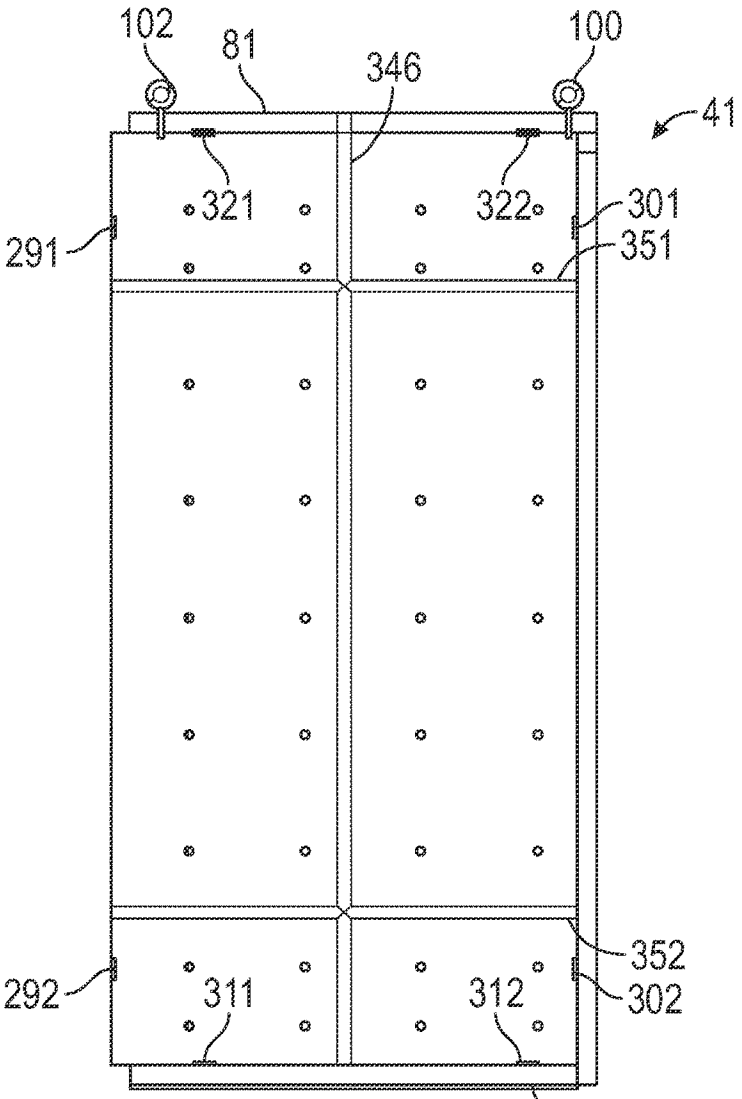
FIG. 16 is another view of the first wall member of FIG. 15 when the support bars are removed.

Referring to FIGS. 10, 12 and 13, the central sheet portion 200 and the side sheet portions 211, 212 form the opening 241 therebetween that receives the attachment board 261 therein. The central sheet portion 200 and the side sheet portions 212, 213 form the opening 242 therebetween that receives the attachment board 262 therein. Also, the central sheet portion 200 and the side sheet portions 221, 222 form the opening 251 therebetween that receives the attachment board 271 therein. Further, the central sheet portion 200 and the side sheet portions 222, 223 form the opening 252 therebetween that receives the attachment board 272 therein. In an exemplary embodiment, the attachment boards 261, 262, 271, 272 are glued to the central sheet portion 200.

Figure 8:
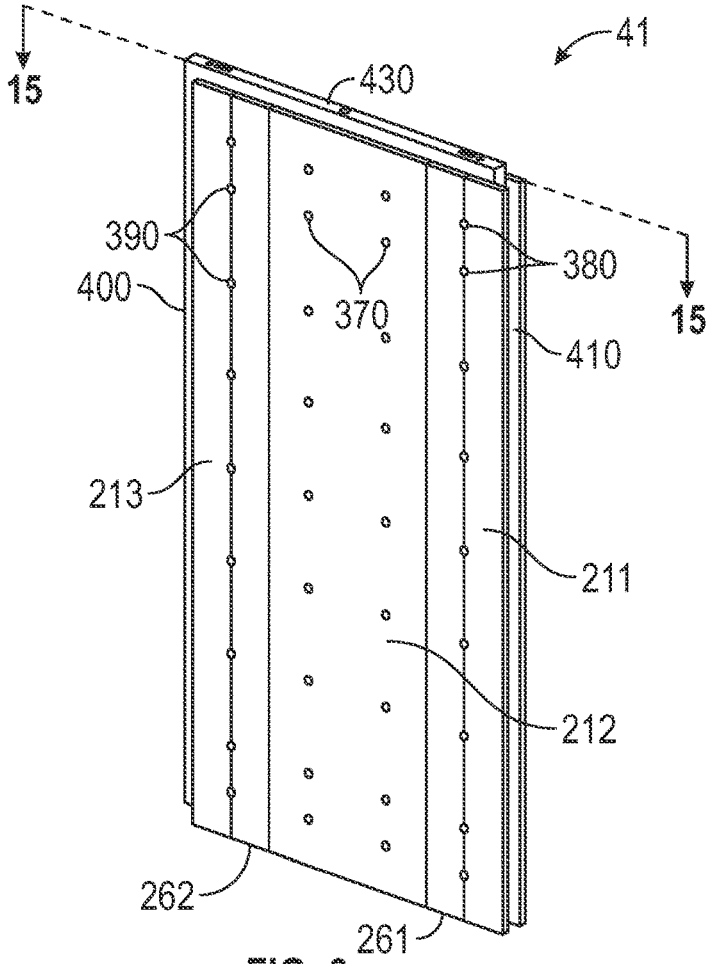
FIG. 8 is an isometric view of a first wall member utilized in the wall assembly of FIG. 1.

Referring to FIGS. 8 and 13, a plurality of apertures 370 extend through the side sheet portions 212, 222 and the central sheet portion 200. Further, a plurality of apertures 380 extend through the side sheet portions 211, 221, the central sheet portion 200, and attachment boards 261, 271. Also, a plurality of apertures 390 extend through the side sheet portions 213, 223, the central sheet portion 200, and the attachment boards 262, 272.

Referring to FIGS. 8, 10 and 13, a side male coupling portion 400 is formed from central sheet portion 200 which extends outwardly past the side sheet portions 213, 223. The magnets 291, 292 (shown in FIG. 15) are disposed in the side male coupling portion 400.

Referring to FIGS. 8, 10, 13 and 14, a side female coupling portion 410 is formed from central sheet portion 200 and the side sheet portions 211, 221 which extend outwardly past the central sheet portion 200. The magnets 301, 302 (shown in FIG. 15) are disposed in the side female coupling portion 410. The side male coupling portion 400 and the side female coupling portion 410 extend parallel to one another.

Figure 9:
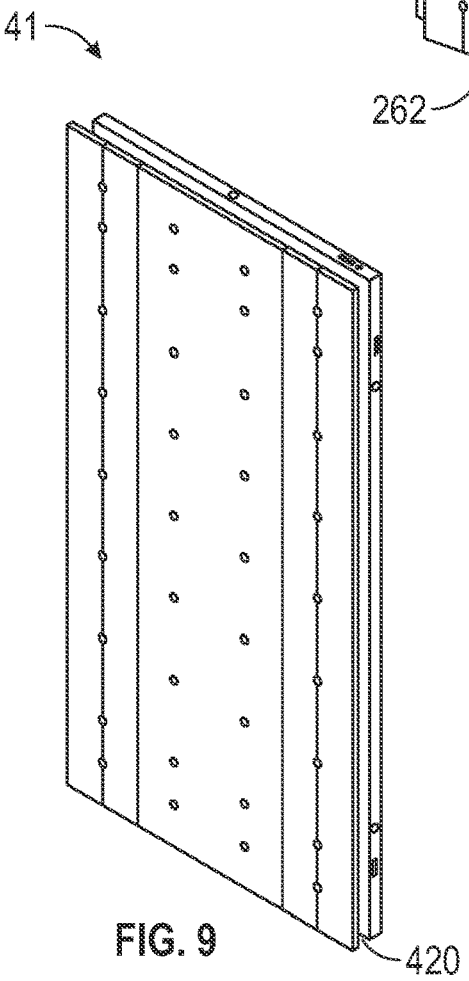
FIG. 9 is another isometric view of the first wall member of FIG. 8.
Figure 15:
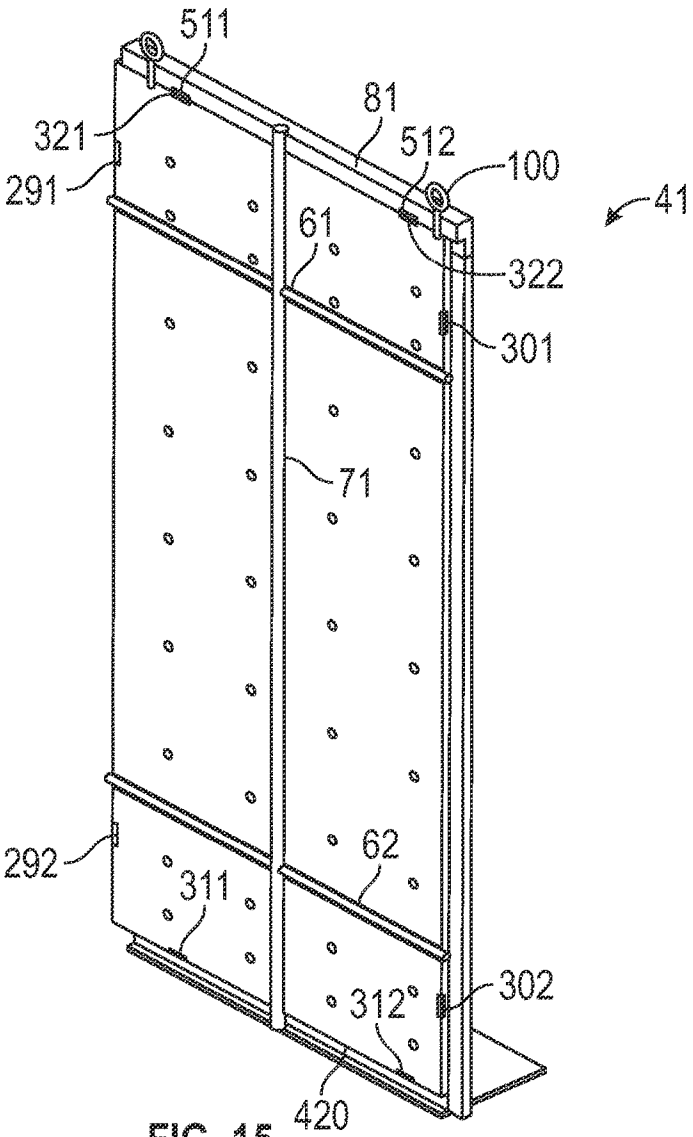
FIG. 15 is a sectional view of the first wall member of FIG. 8 taken along lines 15-15 in FIG. 8 when eye bolts, a base member, and support bars are attached thereto.

Referring to FIGS. 9, 10 and 15, a bottom female coupling portion 420 is formed from central sheet portion 200 and the side sheet portions 211, 212, 213, and the side sheet portions 221, 222, 223. The side sheet portions 211, 212, 213 and the side sheet portions 221, 222, 223 extend downwardly past the central sheet portion 200. The magnets 311, 312 are disposed in the bottom female coupling portion 420.

Referring to FIGS. 8 and 13, a top male coupling portion 430 is formed from the central sheet portion 200 which extends outwardly past the side sheet portions 211, 212, 213 and the side sheet portions 221, 222, 223. The magnets 321, 322 are disposed in the top male coupling portion 430.

In an exemplary embodiment, the central sheet portion 200, the side sheet portions 211, 212, 213, and the side sheet portions 221, 222, 223 are constructed of a bio-based polyurethane foam. In an alternative embodiment, the central sheet portion 200, the side sheet portions 211, 212, 213, and the side sheet portions 221, 222, 223 are constructed of expanded polystyrene foam. In an exemplary embodiment, the attachment boards 261, 262, 271, 272 are constructed of wood. In an alternative embodiment, the attachment boards 261, 262, 271, 272 are constructed of a plastic wood composite. In yet another alternative embodiment, the attachment boards 261, 262, 271, 272 are constructed of a fiberglass material.

First Base Member

Referring to FIGS. 1, 17 and 18, the first base member 51 is provided to removably support and hold the first wall member 41 thereon. The first base member 51 has a base plate 460 and a male coupling portion 462 coupled to and extending upwardly from the base plate 460. The base plate 460 is constructed of a metal and includes a plurality of apertures 470 extending therethrough for mounting the base plate 460 to a floor. The male coupling portion 462 is constructed of a rectangular-shaped metal tube and includes an aperture 480 extending vertically therethrough. The aperture 480 receives the support bar 71 (shown in FIG. 15) therethrough.

Referring to FIGS. 1, 10, 15 and 17, when the first wall member 41 is disposed on the first base member 51, the male coupling portion 462 of the first base member 51 is received in the bottom female coupling portion 420 of the first wall member 41. Further, the magnets 311, 312 (shown in FIG. 15) of the first wall member 41 are magnetically attracted toward the male coupling portion 462.

First Top Cap Member

Referring to FIGS. 1, 15, 19 and 20, the first top cap member 81 is provided to be coupled to a top portion of the first wall member 41. The first top cap member 81 has a U-shaped body 498 with a coupling groove 500. The first top cap member 81 further includes magnets 511, 512 (shown in FIG. 15) disposed therein. When the first top cap member 81 is disposed on the first wall member 41, the coupling groove 500 receives the top male coupling portion 430 (shown in FIG. 8) of the first wall member 41 therein. In other words, the top male coupling portion 430 is disposed in the coupling groove 500. Further, the magnets 511, 512 of the first top cap member 81 are magnetically attracted to the magnets 321, 322, respectively of the first wall member 41 such that the first top cap member 81 is removably coupled to the first wall member 41. In an exemplary embodiment, the first top cap member 81 is constructed of plastic. The eye bolts 100, 102 extend through the first top cap member 81 and into the first wall member 41.

Second Wall Member

Referring to FIGS. 1, 2 and 21-25, the second wall member 42 is provided to be coupled to the first wall member 41, the second base member 52, the top cap member 82, and the corner coupling member 140. The second wall member 42 includes a central sheet portion 600, side sheet portions 611, 612, 613, side sheet portions 621, 622, 623, receiving openings 641, 642, 651, 652, attachment boards 661, 662, 671, 672, and magnets 691, 692, 701, 702, 711, 712, 721, 722.

Referring to FIGS. 21-25, the central sheet portion 600 is substantially rectangular-shaped. The central sheet portion 600 has a first side integrally formed with the side sheet portions 611, 612, 613. The central sheet portion 600 has a second side integrally formed with the side sheet portions 621, 622, 623. The central sheet portion includes a vertical aperture 740 (shown in FIG. 25) and horizontal apertures 751, 752 extending therethrough. The horizontal apertures 751, 752 extend substantially perpendicular to the vertical aperture 740. The vertical aperture 740 is provided to receive the support bar 72 (shown in FIG. 24) therein. The horizontal aperture 751 is provided to receive the support rod 61 (shown in FIG. 24) therein. Also, the horizontal aperture 752 is provided to receive the support rod 62 therein.

Figure 22:
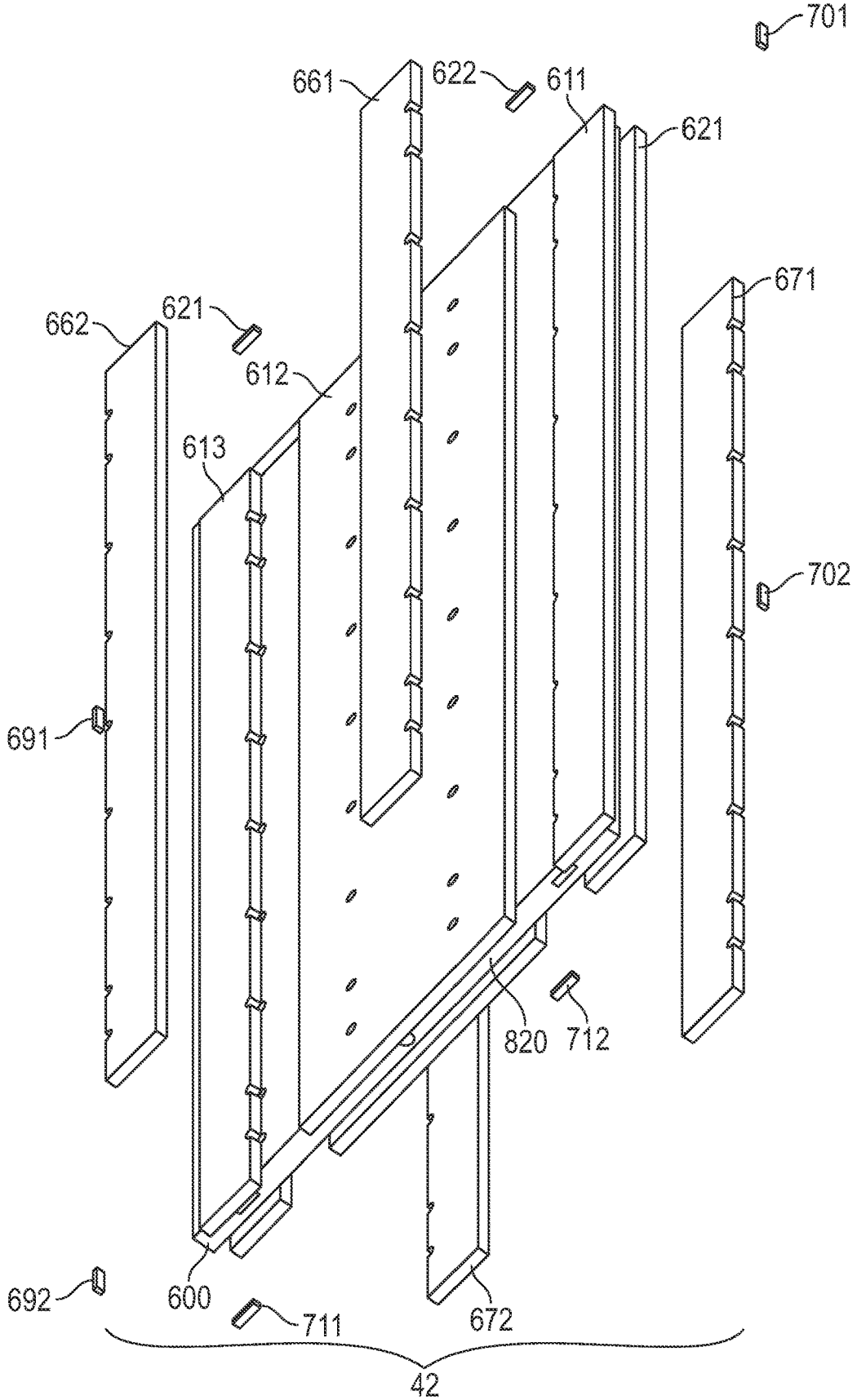
FIG. 22 is an exploded view of the second wall member of FIG. 21.
Figure 23:
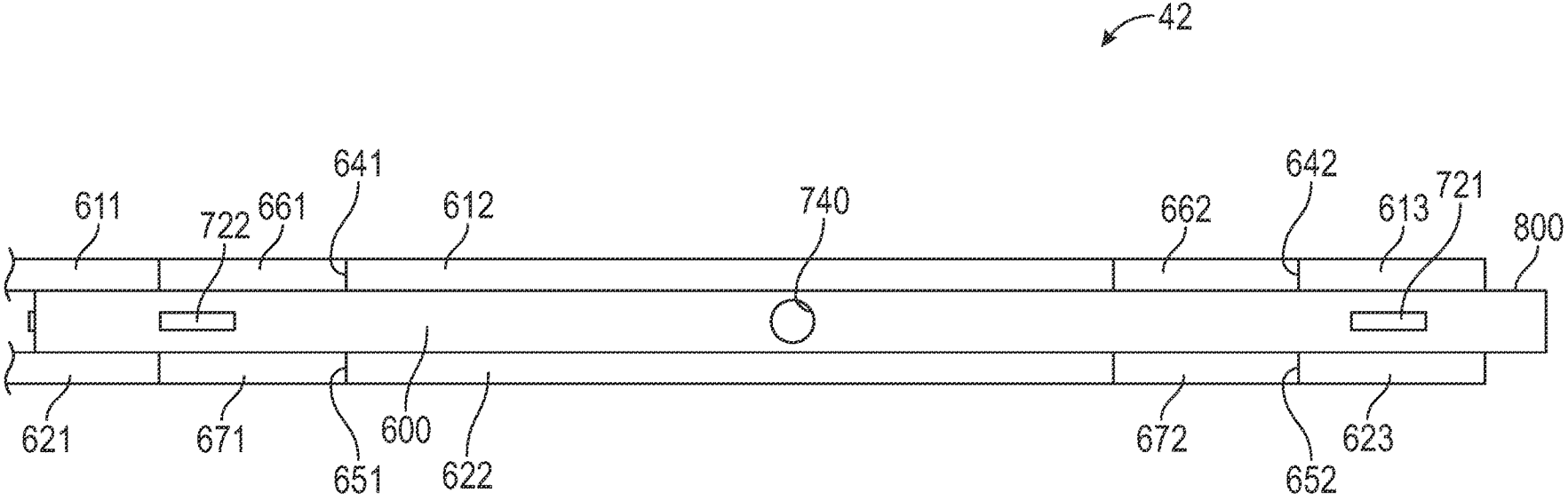
FIG. 23 is a top view of the second wall member of FIG. 21.
Figure 25:
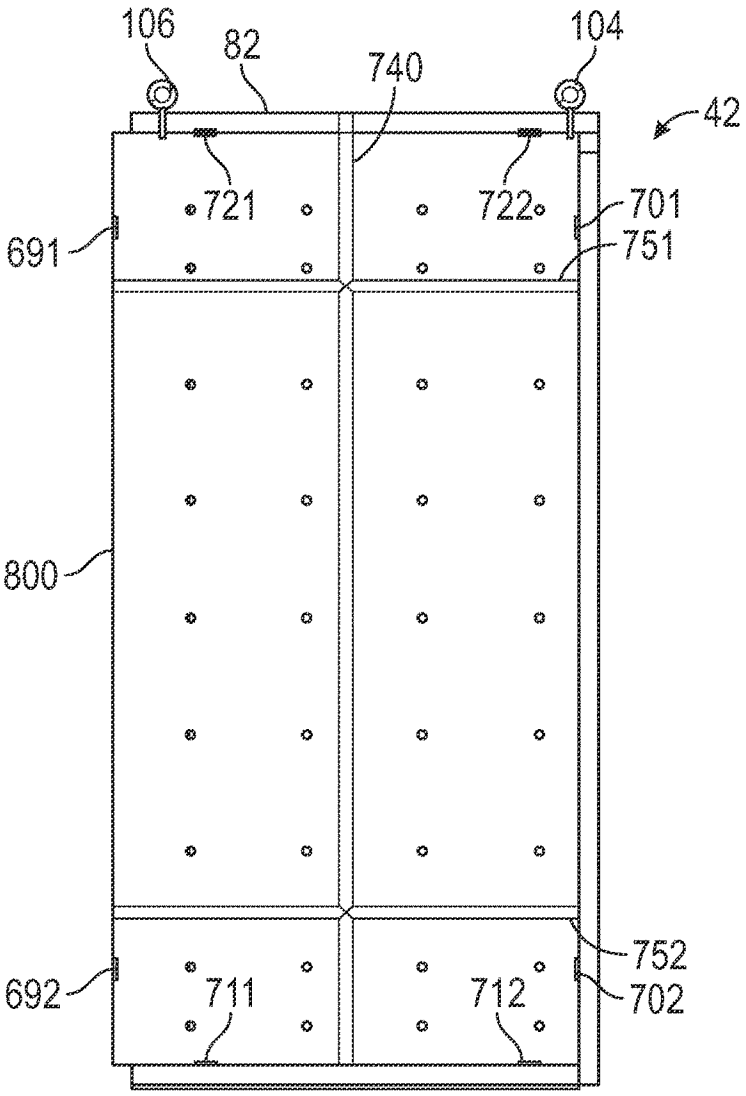
FIG. 25 is another view of the second wall member of FIG. 24 when the support bars are removed.

Referring to FIGS. 22 and 23, the central sheet portion 600 and the side sheet portions 611, 612 form the opening 641 therebetween that receives the attachment board 661 therein. The central sheet portion 600 and the side sheet portions 612, 613 form the opening 642 therebetween that receives the attachment board 662 therein. Also, the central sheet portion 600 and the side sheet portions 621, 622 form the opening 651 therebetween that receives the attachment board 671 therein. Further, the central sheet portion 600 and the side sheet portions 622, 623 form the opening 652 therebetween that receives the attachment board 672 therein. In an exemplary embodiment, the attachment boards 661, 662, 671, 672 are glued to the central sheet portion 600.

Figure 21:
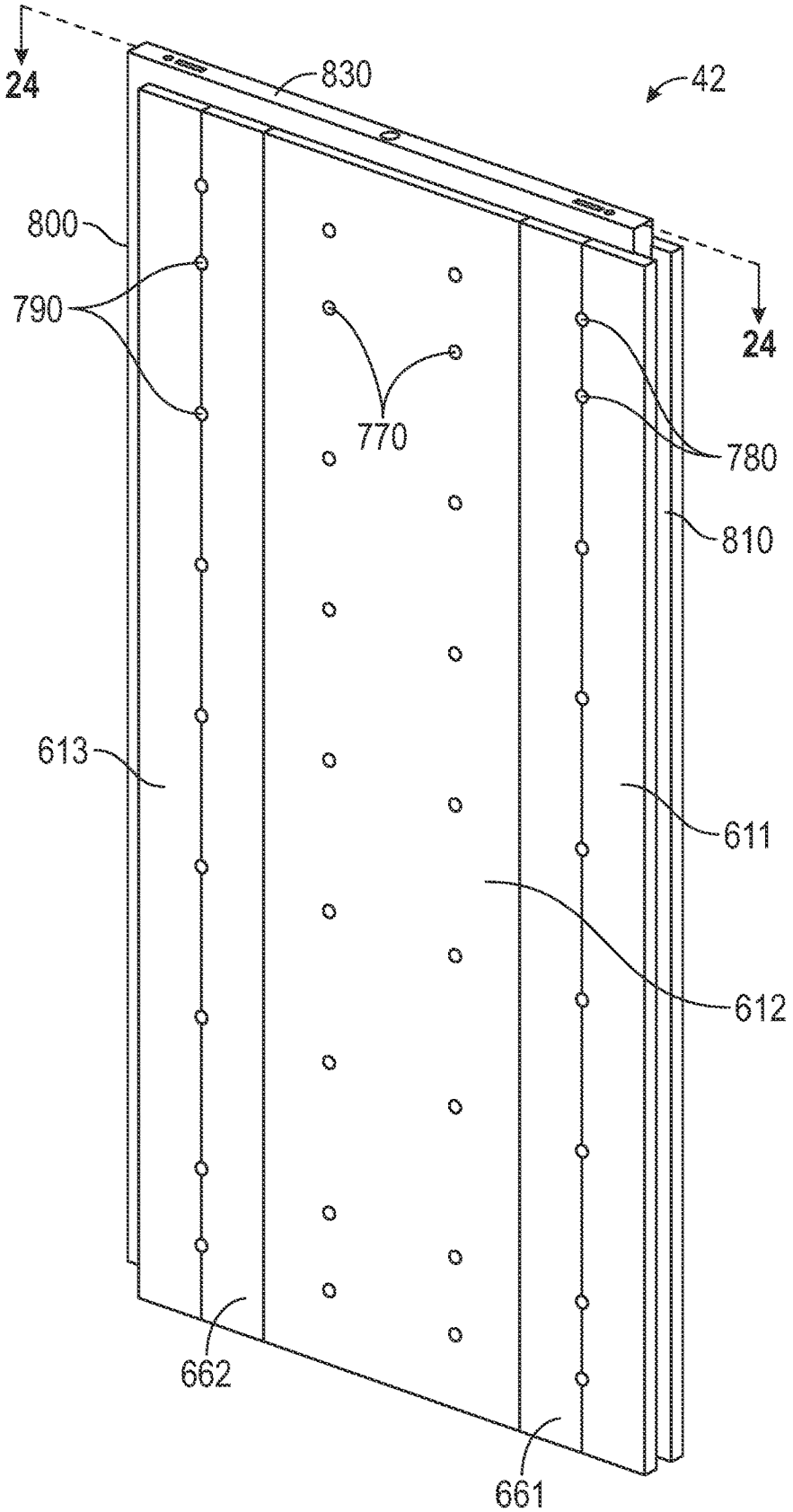
FIG. 21 is an isometric view of a second wall member utilized in the wall assembly of FIG. 1.

Referring to FIGS. 21 and 23, a plurality of apertures 770 extend through the side sheet portions 612, 622 and the central sheet portion 600. Further, a plurality of apertures 780 extend through the side sheet portions 611, 621, the central sheet portion 600, and attachment boards 661, 671. Also, a plurality of apertures 790 extend through the side sheet portions 613, 623, the central sheet portion 600, and the attachment boards 662, 672.

Referring to FIGS. 21-23, a side male coupling portion 800 is formed from central sheet portion 600 which extends outwardly past the side sheet portions 613, 623. The magnets 691, 692 (shown in FIG. 25) are disposed in the side male coupling portion 800.

A side female coupling portion 810 is formed from central sheet portion 600 and the side sheet portions 611, 621 which extend outwardly past the central sheet portion 600. The magnets 701, 702 (shown in FIG. 25) are disposed in the side female coupling portion 810. The side male coupling portion 800 and the side female coupling portion 810 extend parallel to one another.

Figure 24:
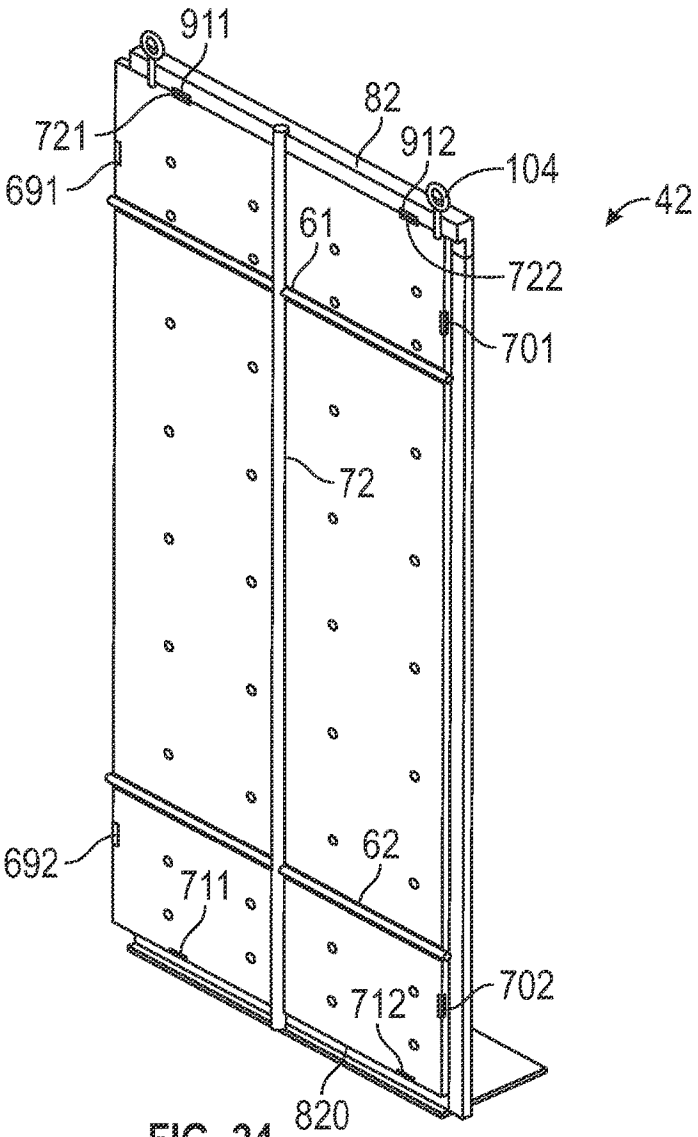
FIG. 24 is a sectional view of the second wall member of FIG. 21 taken along lines 24-24 in FIG. 21 when eye bolts, a base member, and support bars are attached thereto.

Referring to FIGS. 22 and 24, a bottom female coupling portion 820 is formed from central sheet portion 600 and the side sheet portions 611, 612, 613, and the side sheet portions 621, 622, 623. The side sheet portions 611, 612, 613 and the side sheet portions 621, 622, 623 extend past the central sheet portion 600. The magnets 711, 712 are disposed in the bottom female coupling portion 820.

Referring to FIGS. 21 and 23, a top male coupling portion 830 is formed from the central sheet portion 600 which extends outwardly past the side sheet portions 611, 612, 613 and the side sheet portions 621, 622, 623. The magnets 721, 722 are disposed in the top male coupling portion 830.

In an exemplary embodiment, the central sheet portion 600, the side sheet portions 611, 612, 613, and the side sheet portions 621, 622, 623 are constructed of a bio-based polyurethane foam. In an alternative embodiment, the central sheet portion 600, the side sheet portions 611, 612, 613, and the side sheet portions 621, 622, 623 are constructed of expanded polystyrene foam. In an exemplary embodiment, the attachment boards 661, 662, 671, 672 are constructed of wood. In an alternative embodiment, the attachment boards 661, 662, 671, 672 are constructed of a plastic wood composite. In yet another alternative embodiment, the attachment boards 661, 662, 671, 672 are constructed of a fiberglass material.

Second Base Member

Figure 26:
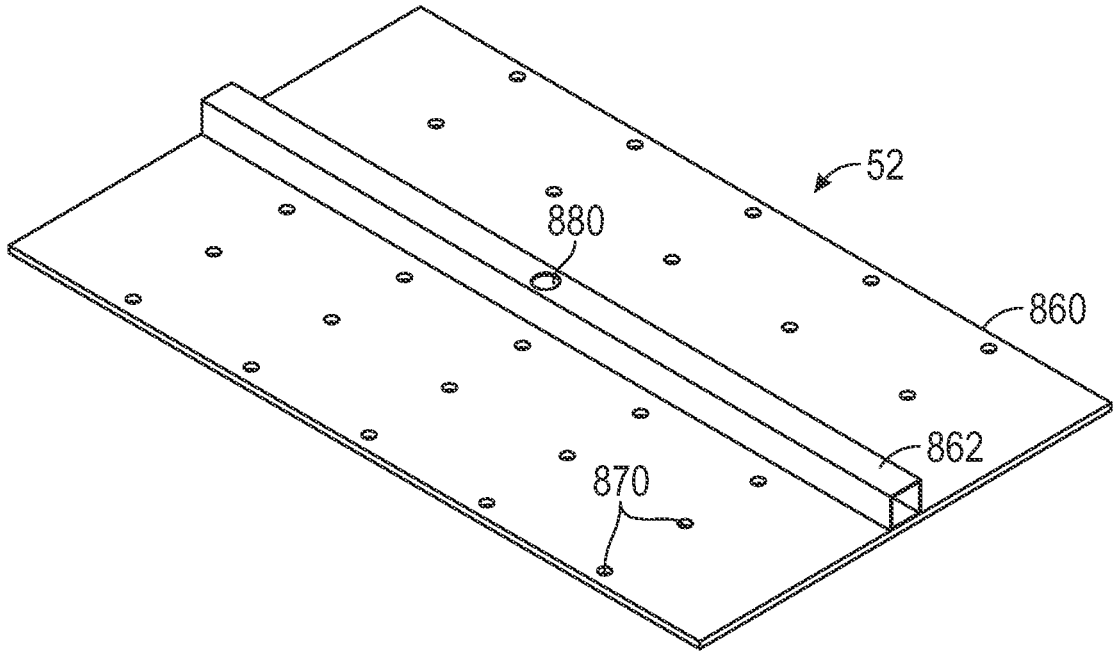
FIG. 26 is an isometric view of a second base member utilized in the wall assembly of FIG. 1.
Figure 27:
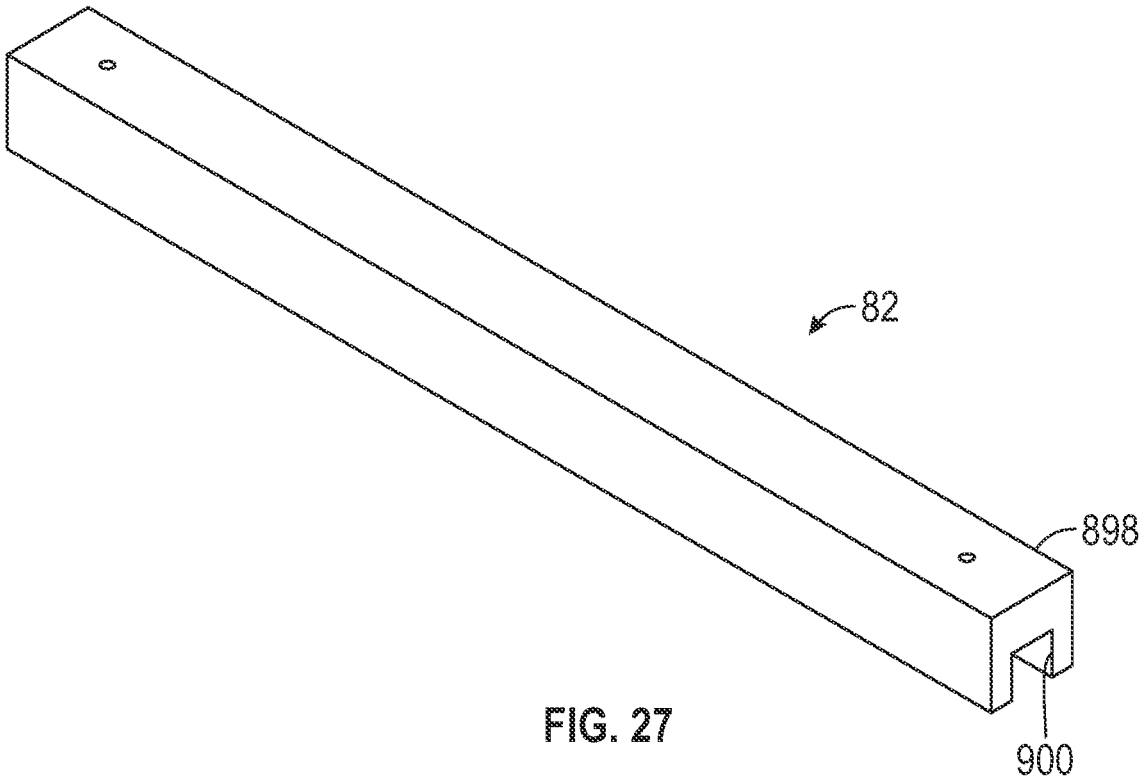
FIG. 27 is an isometric view of another top cap member utilized in the wall assembly of FIG. 1.

Referring to FIGS. 1 and 26, the second base member 52 is provided to removably support and hold the second wall member 42 thereon. The second base member 52 has a base plate 860 and a male coupling portion 862 coupled to and extending upwardly from the base plate 860. The base plate 860 is constructed of a metal and includes a plurality of apertures 870 extending therethrough for mounting the base plate 860 to a floor. The male coupling portion 862 is constructed of a rectangular-shaped metal tube and includes an aperture 880 extending vertically therethrough. The aperture 880 receives the support bar 72 (shown in FIG. 24) therethrough.

Referring to FIGS. 1, 21, 24 and 25, when the second wall member 42 is disposed on the second base member 52, the male coupling portion 862 of the second base member 52 is received in the bottom female coupling portion 820 of the second wall member 42. Further, the magnets 711, 712 (shown in FIG. 24) of the second wall member 42 are magnetically attracted toward the male coupling portion 862.

Second Top Cap Member

Referring to FIGS. 1, 24, 25 and 27, the second top cap member 82 is provided to be coupled to a top portion of the second wall member 42. The second top cap member 82 has a U-shaped body 898 with a coupling groove 900. The second top cap member 82 further includes magnets 911, 912 (shown in FIG. 24) disposed therein. When the second top cap member 82 is disposed on the second wall member 42, the coupling groove 900 receives the top male coupling portion 830 (shown in FIG. 21) of the second wall member 42 therein. In other words, the top male coupling portion 830 is disposed in the coupling groove 900. Further, the magnets 911, 912 of the second top cap member 82 are magnetically attracted to the magnets 721, 722, respectively of the second wall member 42 such that the second top cap member 82 is removably coupled to the second wall member 42. In an exemplary embodiment, the second top cap member 82 is constructed of plastic. Further, the eye bolts 104, 106 extend through the second top cap member 82 and into the second wall member 42.

Third Wall Member

Referring to FIGS. 1, 2 and 28-32, the third wall member 43 is provided to be coupled to the third base member 53, the third top cap member 83, the corner coupling member 140, and the end cap member 150. The third wall member 43 includes a central sheet portion 1000, side sheet portions 1011, 1012, 1013, side sheet portions 1021, 1022, 1023, receiving openings 1041, 1042, 1051, 1052, attachment boards 1061, 1062, 1071, 1072, and magnets 1091, 1092, 1101, 1102, 1111, 1112, 1121, 1122.

Referring to FIGS. 29-32, the central sheet portion 1000 is substantially rectangular-shaped. The central sheet portion 1000 has a first side integrally formed with the side sheet portions 1011, 1012, 1013. The central sheet portion 1000 has a second side integrally formed with the side sheet portions 1021, 1022, 1023. The central sheet portion 1000 includes a vertical aperture 1140 (shown in FIG. 32) and horizontal apertures 1151, 1152 extending therethrough. The horizontal apertures 1151, 1152 extend substantially perpendicular to the vertical aperture 1140. The vertical aperture 1140 is provided to receive the support bar 73 (shown in FIG. 31) therein. The horizontal aperture 1151 is provided to receive the support rod 63 (shown in FIG. 31) therein. Also, the horizontal aperture 1152 is provided to receive the support rod 64 therein.

Figure 28:
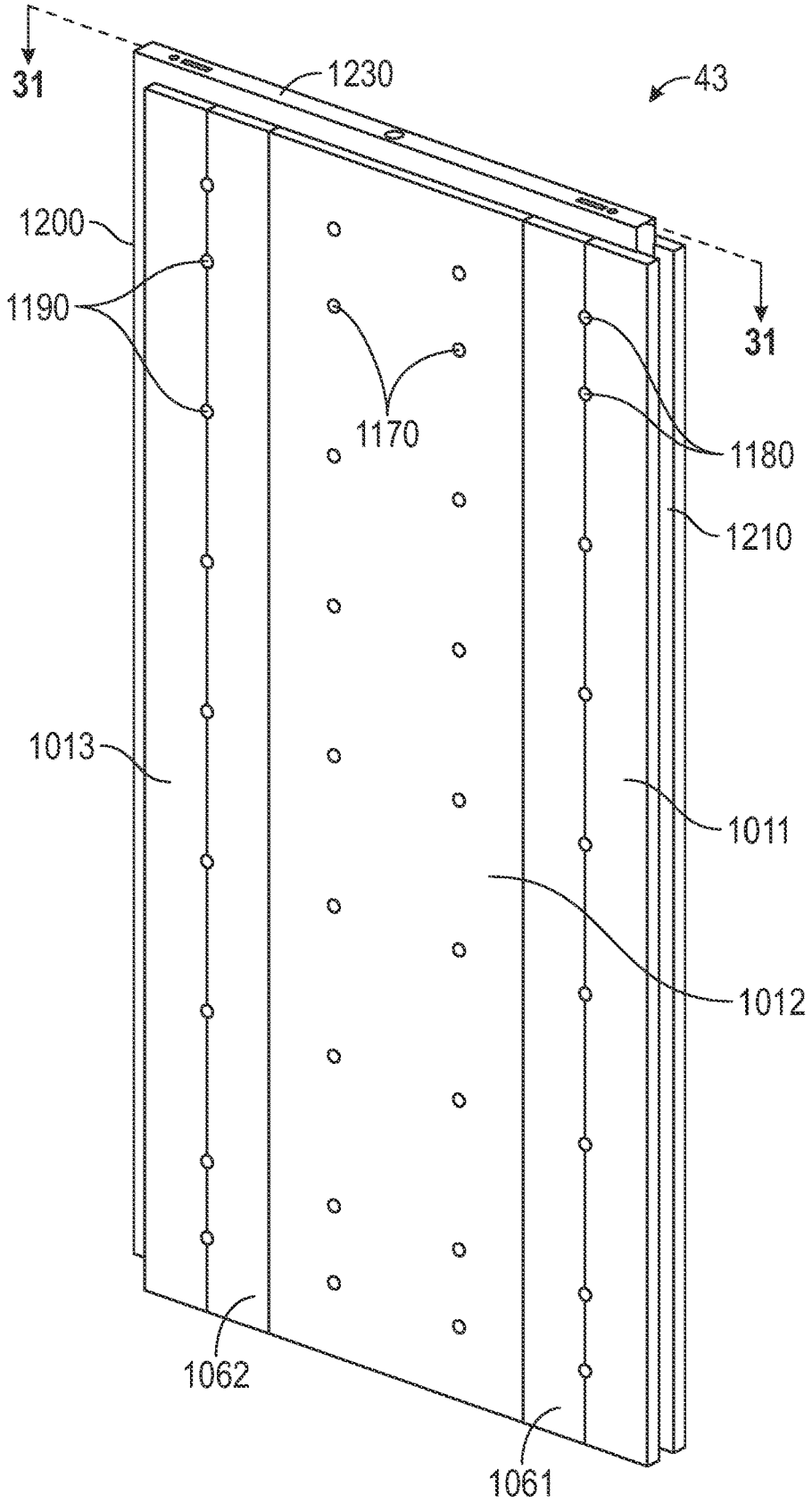
FIG. 28 is an isometric view of a third wall member utilized in the wall assembly of FIG. 1.
Figure 29:
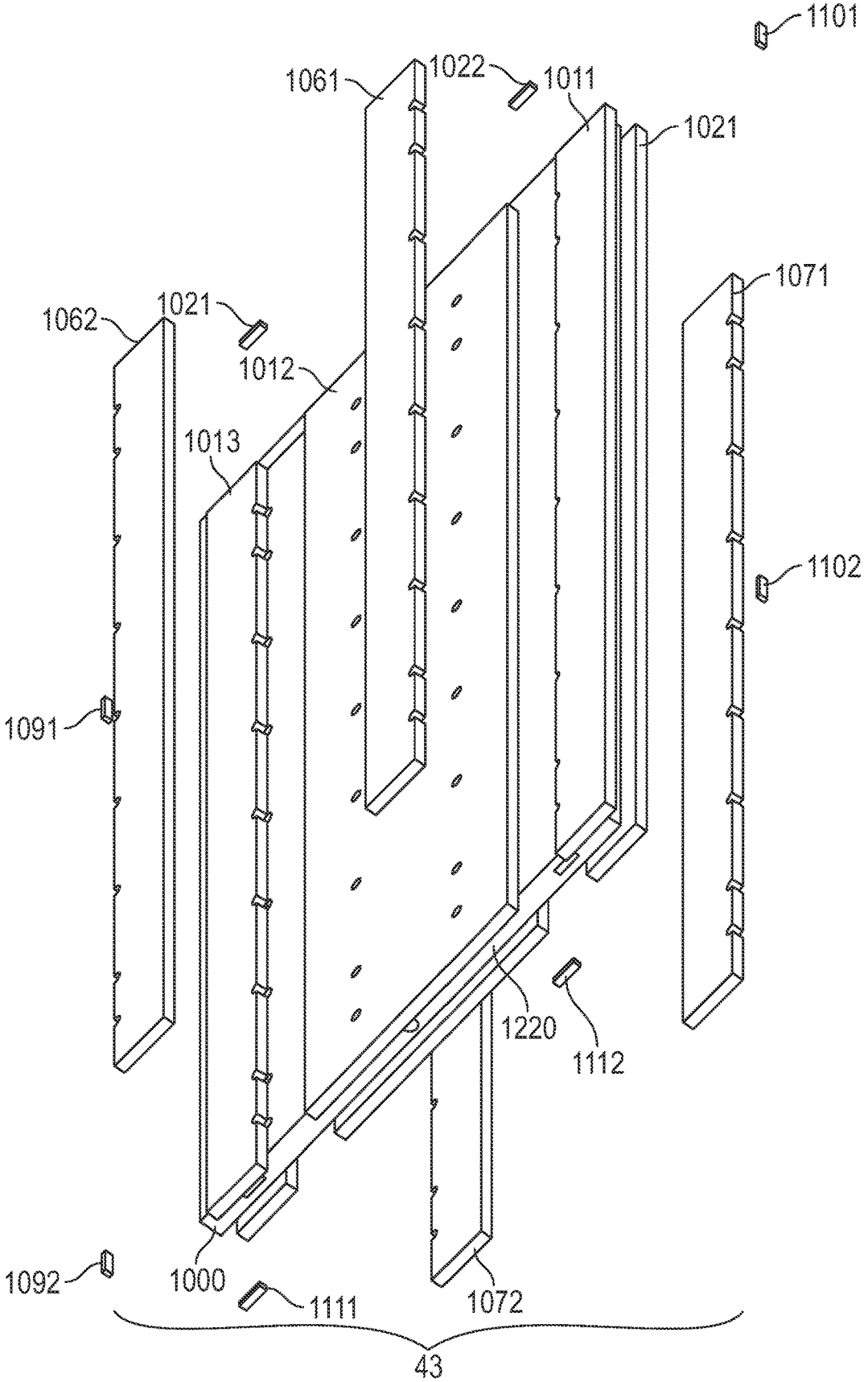
FIG. 29 is an exploded view of the third wall member of FIG. 28.

Referring to FIGS. 28 and 29, the central sheet portion 1000 and the side sheet portions 1011, 1012 form the opening 1041 therebetween that receives the attachment board 1061 therein. The central sheet portion 1000 and the side sheet portions 1012, 1013 form the opening 1042 therebetween that receives the attachment board 1062 therein. Also, the central sheet portion 1000 and the side sheet portions 1021, 1022 form the opening 1051 therebetween that receives the attachment board 1071 therein. Further, the central sheet portion 1000 and the side sheet portions 1022, 1023 form the opening 1052 therebetween that receives the attachment board 1072 therein. In an exemplary embodiment, the attachment boards 1061, 1062, 1071, 1072 are glued to the central sheet portion 1000.

Figure 30:
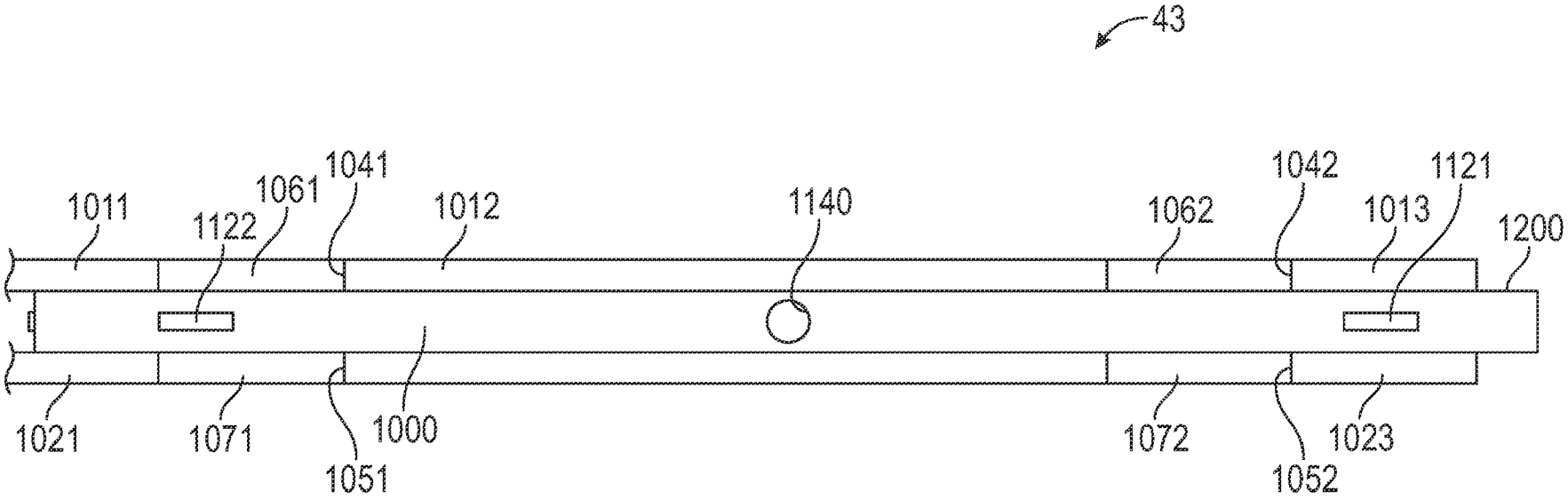
FIG. 30 is a top view of the third wall member of FIG. 28.
Figure 32:
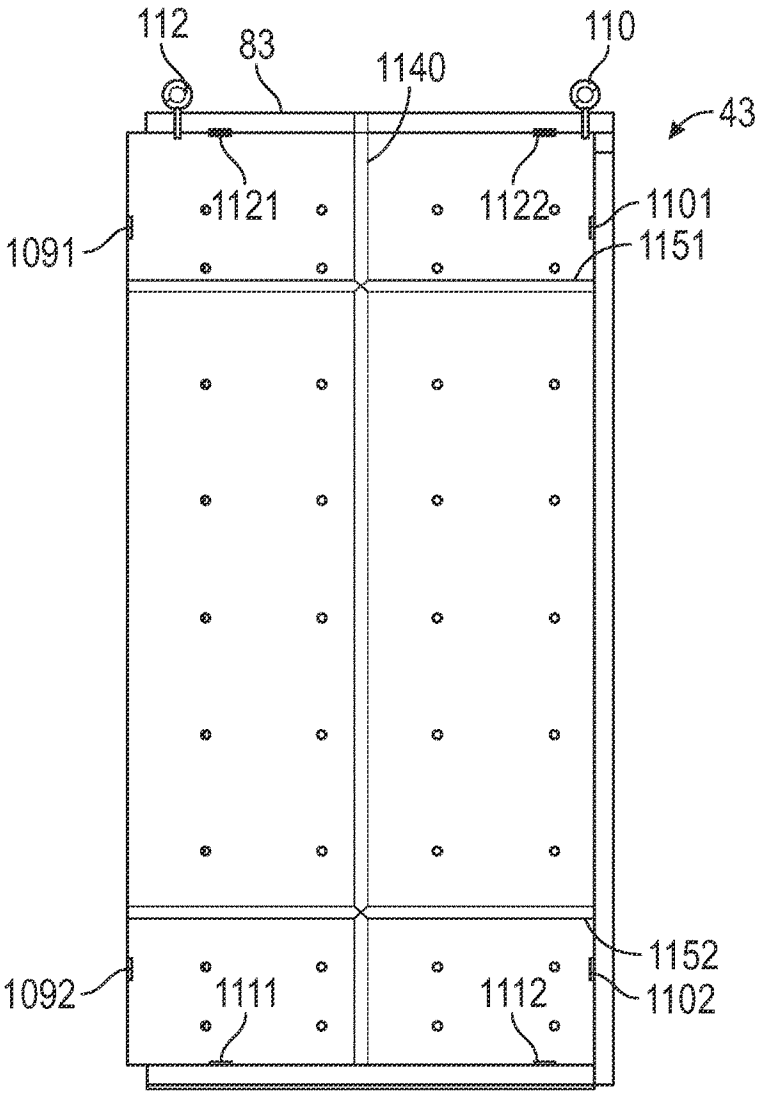
FIG. 32 is another view of the third wall member of FIG. 31 when the support bars are removed.

Referring to FIGS. 28 and 30, a plurality of apertures 1170 extend through the side sheet portions 1012, 1022 and the central sheet portion 1000. Further, a plurality of apertures 1180 extend through the side sheet portions 1011, 1021, the central sheet portion 1000, and attachment boards 1061, 1071. Also, a plurality of apertures 1190 extend through the side sheet portions 1013, 1023, the central sheet portion 1000, and the attachment boards 1062, 1072.

Referring to FIGS. 28-30, a side male coupling portion 1200 is formed from central sheet portion 1000 which extends outwardly past the side sheet portions 1013, 1023. The magnets 1091, 1092 (shown in FIG. 31) are disposed in the side male coupling portion 1200.

A side female coupling portion 1210 is formed from central sheet portion 1000 and the side sheet portions 1011, 1021 which extend outwardly past the central sheet portion 1000. The magnets 1101, 1102 (shown in FIG. 31) are disposed in the side female coupling portion 1210. The side male coupling portion 1200 and the side female coupling portion 1210 extend parallel to one another.

Figure 31:
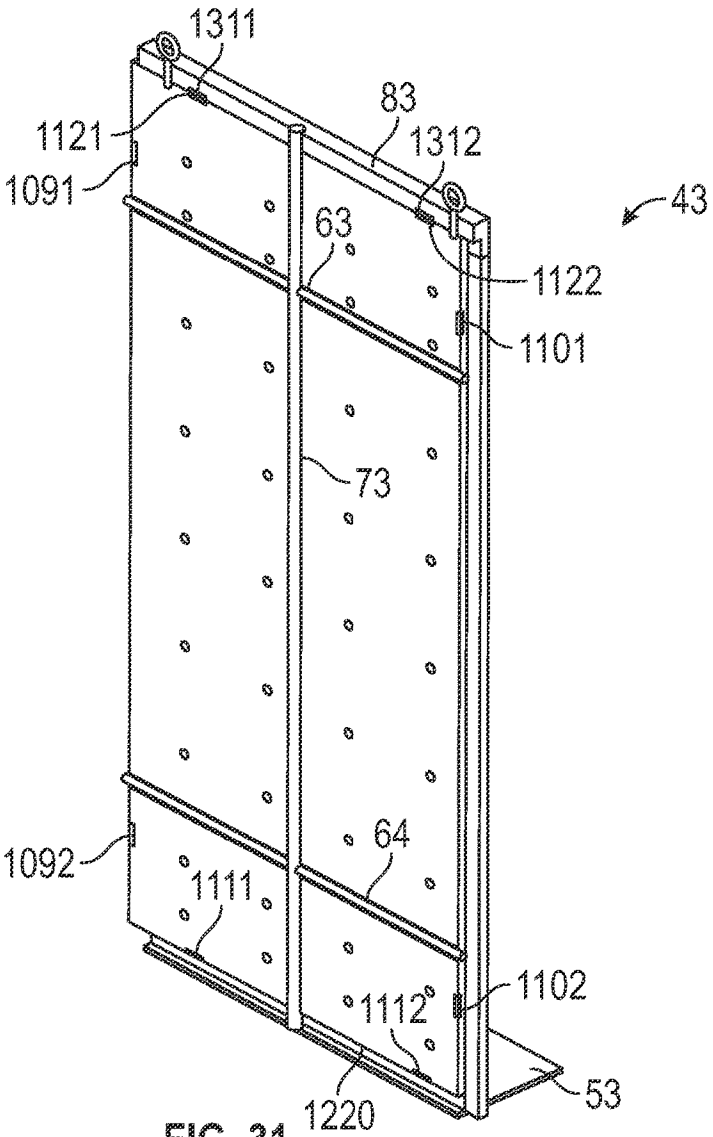
FIG. 31 is a sectional view of the third wall member of FIG. 28 taken along lines 31-31 in FIG. 28 when eye bolts, a base member, and support bars are attached thereto.

Referring to FIGS. 29 and 31, a bottom female coupling portion 1220 is formed from central sheet portion 1000 and the side sheet portions 1011, 1012, 1013, and the side sheet portions 1021, 1022, 1023. The side sheet portions 1011, 1012, 1013 and the side sheet portions 1021, 1022, 1023 extend past the central sheet portion 1000. The magnets 1111, 1112 are disposed in the bottom female coupling portion 1220.

Referring to FIGS. 28 and 30, a top male coupling portion 1230 is formed from the central sheet portion 1000 which extends outwardly past the side sheet portions 1011, 1012, 1013 and the side sheet portions 1021, 1022, 1023. The magnets 1121, 1122 are disposed in the top male coupling portion 1230.

In an exemplary embodiment, the central sheet portion 1000, the side sheet portions 1011, 1012, 1013, and the side sheet portions 1021, 1022, 1023 are constructed of a bio-based polyurethane foam. In an alternative embodiment, the central sheet portion 1000, the side sheet portions 1011, 1012, 1013, and the side sheet portions 1021, 1022, 1023 are constructed of expanded polystyrene foam. In an exemplary embodiment, the attachment boards 1061, 1062, 1071, 1072 are constructed of wood. In an alternative embodiment, the attachment boards 1061, 1062, 1071, 1072 are constructed of a plastic wood composite. In yet another alternative embodiment, the attachment boards 1061, 1062, 1071, 1072 are constructed of a fiberglass material.

Third Base Member

Figure 33:
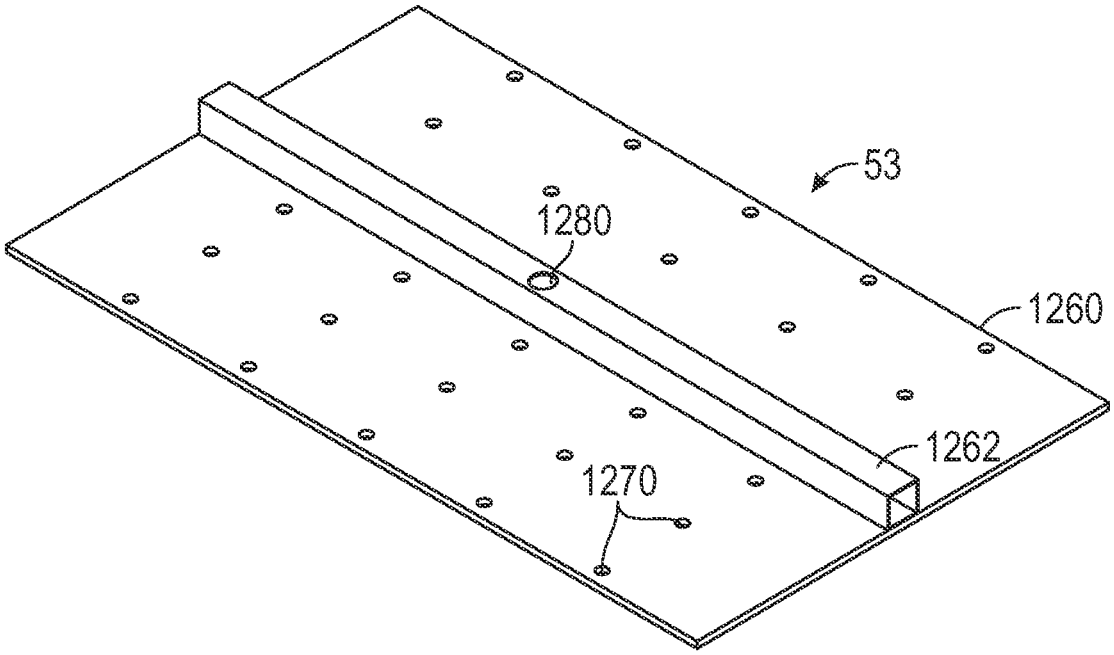
FIG. 33 is an isometric view of a third base member utilized in the wall assembly of FIG. 1.
Figure 34:
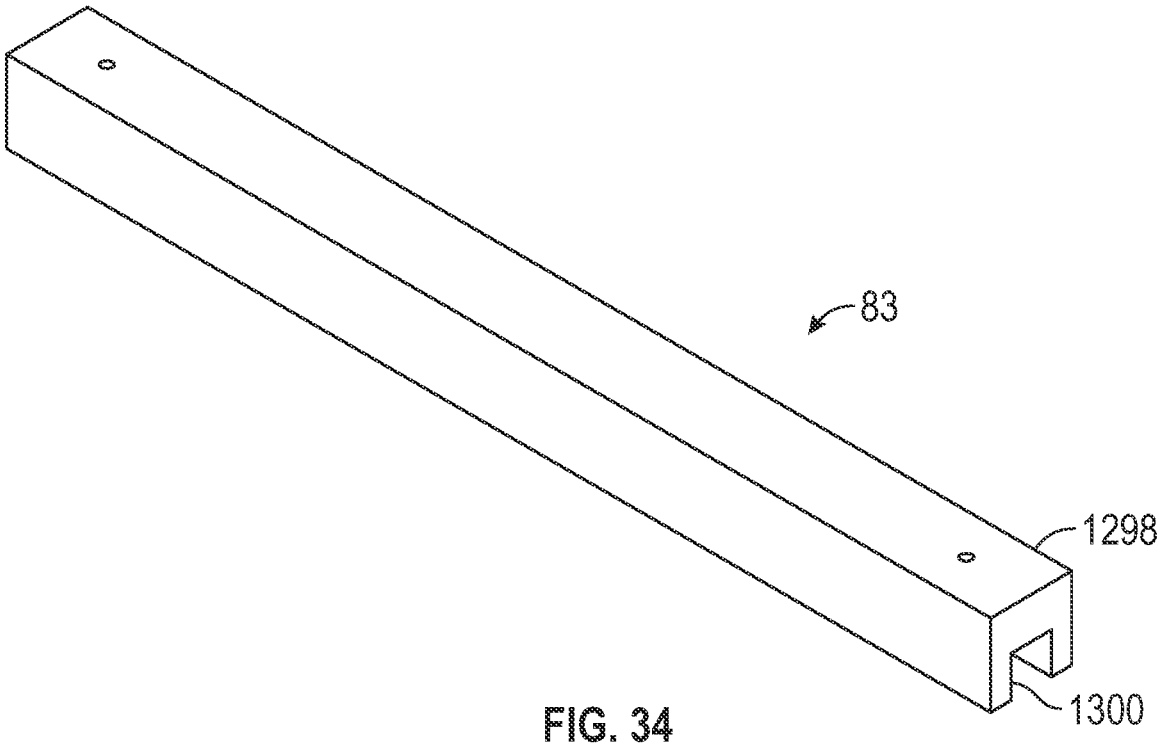
FIG. 34 is an isometric view of another top cap member utilized in the wall assembly of FIG. 1.
Figure 35:
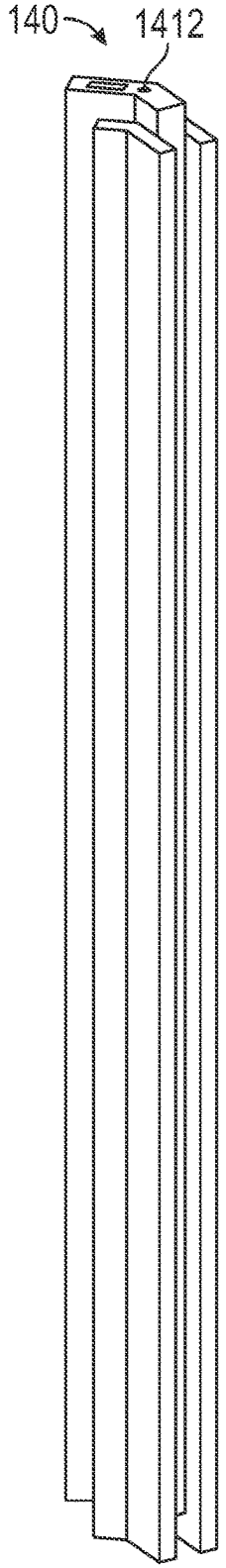
FIG. 35 is an isometric view of a corner coupling member utilized in the wall assembly of FIG. 1.
Figure 36:
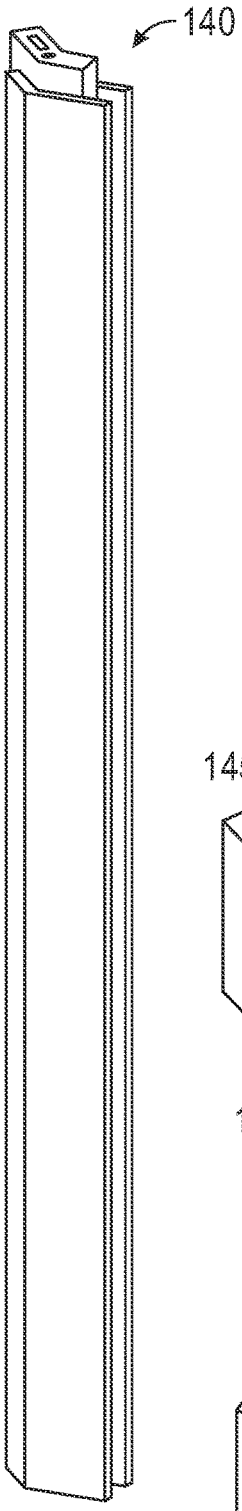
FIG. 36 is another isometric view of the corner coupling member of FIG. 35.

Referring to FIGS. 1 and 33, the third base member 53 is provided to removably support and hold the third wall member 43 thereon. The third base member 53 has a base plate 1260 and a male coupling portion 1262 coupled to and extending upwardly from the base plate 1260. The base plate 1260 is constructed of a metal and includes a plurality of apertures 1270 extending therethrough for mounting the base plate 1260 to a floor. The male coupling portion 1262 is constructed of a rectangular-shaped metal tube and includes an aperture 1280 extending vertically therethrough. The aperture 1280 receives the support bar 73 (shown in FIG. 31) therethrough.

Referring to FIGS. 1, 28, 31 and 32, when the third wall member 43 is disposed on the third base member 53, the male coupling portion 1262 of the third base member 53 is received in the bottom female coupling portion 1220 of the third wall member 43. Further, the magnets 1111, 1112 (shown in FIG. 32) of the third wall member 43 are magnetically attracted toward the male coupling portion 1262.

Third Top Cap Member

Referring to FIGS. 1, 28, 30, 31 and 34, the third top cap member 83 is provided to be coupled to a top portion of the third wall member 43. The third top cap member 83 has a U-shaped body 1298 with a coupling groove 1300. The third top cap member 83 further includes magnets 1311, 1312 (shown in FIG. 31) disposed therein. When the third top cap member 83 is disposed on the third wall member 43, the coupling groove 1300 receives the top male coupling portion 1230 (shown in FIG. 28) of the third wall member 43 therein. In other words, the top male coupling portion 1230 is disposed in the coupling groove 1300. Further, the magnets 1311, 1312 of the third top cap member 83 are magnetically attracted to the magnets 1121, 1122, respectively of the third wall member 43 such that the third top cap member 83 is removably coupled to the third wall member 43. In an exemplary embodiment, the third top cap member 83 is constructed of plastic. The eye bolts 110, 112 extend through the third top cap member 83 and into the third wall member 43.

Corner Coupling Member

Referring to FIGS. 1 and 35-37, the corner coupling member 140 is provided to be removably coupled to and between the second wall member 42 and the third wall member 43 and orients the walls 42, 43 substantially 135 degrees relative to one another. The corner coupling member 140 includes a U-shaped inner wall 1350, U-shaped outer walls 1361, 1362, and a magnet 1365. In an exemplary embodiment, the U-shaped inner wall 1350 and the U-shaped outer walls 1361, 1362 are integrally formed to one another and are constructed of plastic.

The U-shaped inner wall 1350 includes wall portions 1371, 1372 which are integrally formed together. The wall portions 1371, 1372 extend substantially 120 degrees with respect to one another. The magnet 1365 is disposed in the wall portion 1372.

The U-shaped outer wall 1361 includes wall portions 1381, 1382 which are integrally formed together. The wall portions 1381, 1382 extend substantially 120 degrees with respect to one another. The wall portion 1381 is coupled to the first side of the wall portion 1371. Further, the wall portion 1382 is coupled to a first side of the wall portion 1372.

The U-shaped outer wall 1362 includes wall portions 1391, 1392 which are integrally formed together. The wall portions 1391, 1392 extend substantially 135 degrees with respect to one another. The wall portion 1391 is coupled to a second side of the wall portion 1371. Further, the wall portion 1392 is coupled to a second side of the wall portion 1372.

A side female coupling portion 1400 is formed from the wall portion 1371 and the wall portions 1381, 1391 which extend outwardly past the wall portion 1371. Also, a side male coupling portion 1410 is formed from the wall portion 1372 which extends outwardly past the wall portions 1382, 1392. Further, a top male coupling portion 1412 (shown in FIG. 35) is formed from the U-shaped inner wall 1350 which extends upwardly past the U-shaped outer walls 1361, 1362.

Figure 37:
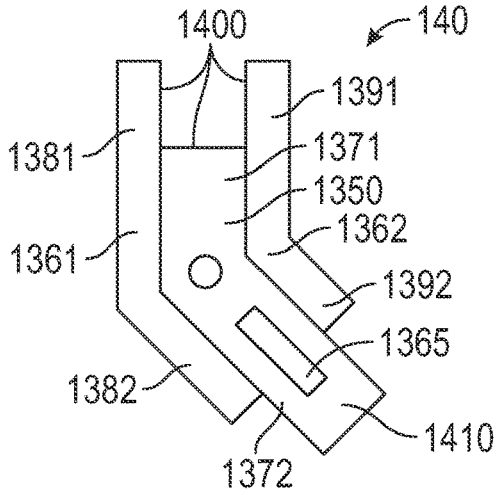
FIG. 37 is a top view of the corner coupling member of FIG. 35.
Figure 38:
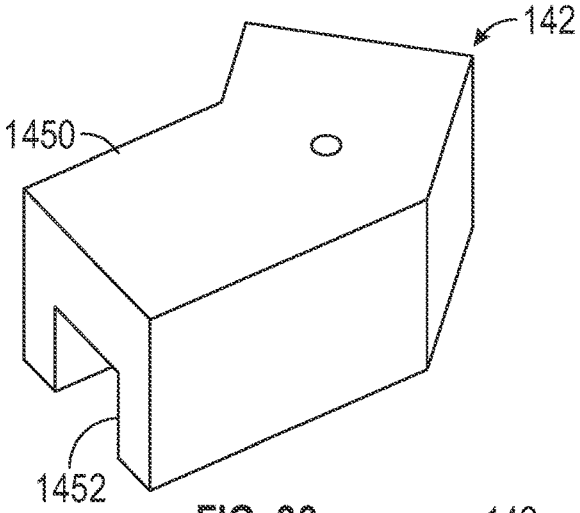
FIG. 38 is an isometric view of a corner cap member utilized in the wall assembly of FIG. 1.
Figure 39:
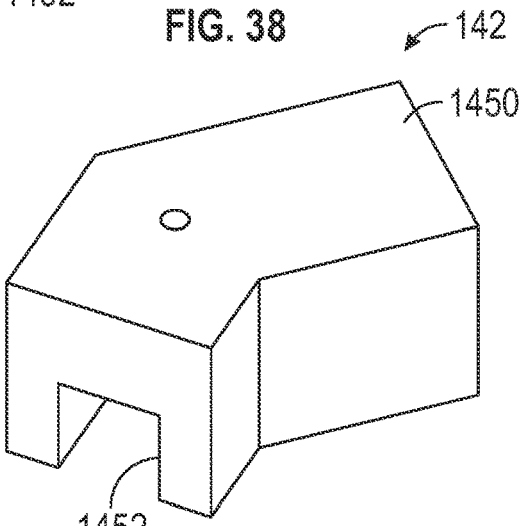
FIG. 39 is another isometric view of the corner cap member of FIG. 38.
Figure 40:
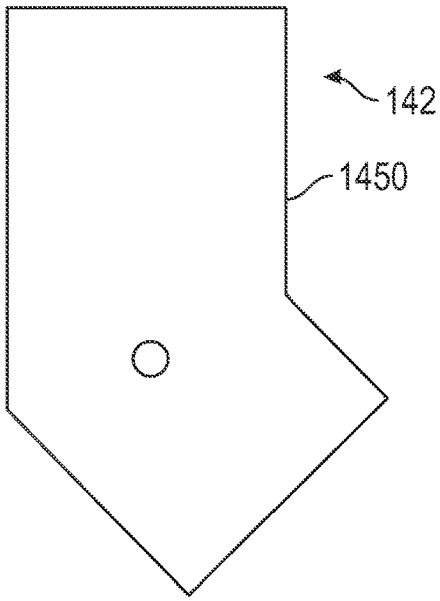
FIG. 40 is a top view of the corner cap member of FIG. 38.

Referring to FIGS. 1, 21 and 37, when the corner coupling member 140 is disposed against and coupled to the second wall member 42, the side male coupling portion 800 of the second wall member 42 is received in the side female coupling portion 1400 of the corner coupling member 140.

Referring to FIGS. 1, 28 and 37, when the corner coupling member 140 is disposed against and coupled to the third wall member 43, the side male coupling portion 1410 of the corner coupling member 140 is received in the side female coupling portion 1210 of the third wall member 43.

Corner Cap Member

Referring to FIGS. 1 and 38-40, the corner cap member 142 is provided to be coupled to a top portion of the corner coupling member 140. The corner cap member 142 has a U-shaped body 1450 with a U-shaped coupling groove 1452. When the corner cap member 142 is disposed on the corner coupling member 140, the U-shaped coupling groove 1452 receives the top male coupling portion 1412 (shown in FIG. 35) of the corner coupling member 140. In other words, the top male coupling portion 1412 is disposed in the coupling groove 1452. In an exemplary embodiment, the corner cap member 142 is constructed of plastic. The eye bolt 108 extends through the corner cap member 142 and into the corner coupling member 140.

End Cap Member

Figure 42:
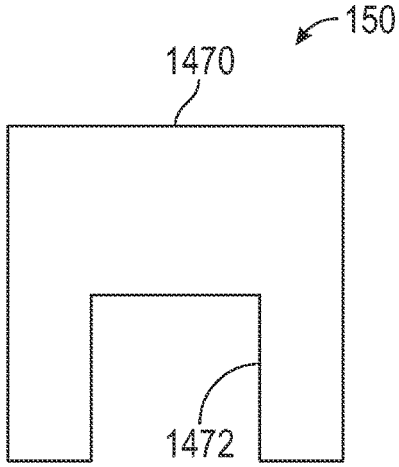
FIG. 42 is a top view of the end cap member of FIG. 41.
Figure 41:
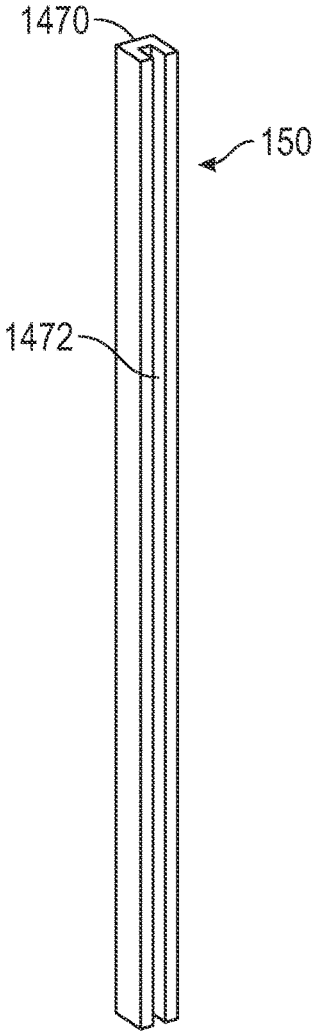
FIG. 41 is an isometric view of an end cap member utilized in the wall assembly of FIG. 1.

Referring to FIGS. 1 and 41-42, the end cap member 150 is provided to be removably coupled to a side portion of the third wall member 43. The end cap member 150 includes a U-shaped body 1470 having a coupling groove 1472 therein. In an exemplary embodiment, the end cap member 150 is constructed of plastic. When the end cap member 150 is disposed on the third wall member 43, the coupling groove 1472 receives the side male coupling portion 1200 (shown in FIG. 28) of the third wall member 43 therein. In other words, the side male coupling portion 1200 is disposed in the coupling groove 1472.

Top Cap Member

Figure 43:
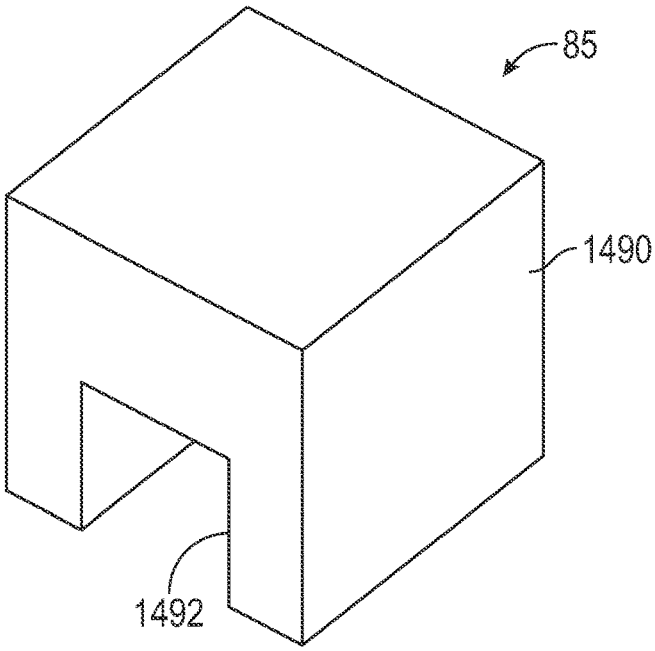
FIG. 43 is an isometric view of another top cap member utilized in the wall assembly of FIG. 1.

Referring to FIGS. 1 and 43, the top cap member 85 is provided to be removably coupled to a side portion of the third wall member 43. The top cap member 85 includes a U-shaped body 1490 having a coupling groove 1492 therein. In an exemplary embodiment, the top cap member 85 is constructed of plastic. When top cap member 85 is disposed on the third wall member 43, the coupling groove 1492 receives a portion of the side male coupling portion 1200 (shown in FIG. 28) of the third wall member 43 therein. In other words, a portion of the side male coupling portion 1200 is disposed in the coupling groove 1492.

Fourth Wall Member

Referring to FIGS. 1, 2 and 44-48, the fourth wall member 44 is provided to be coupled to the fourth base member 54, the fourth top cap member 84, the corner coupling member 160, and the end cap member 170. The fourth wall member 44 includes a central sheet portion 1500, side sheet portions 1511, 1512, 1513, side sheet portions 1521, 1522, 1523, receiving openings 1541, 1542, 1551, 1552, attachment boards 1561, 1562, 1571, 1572, and magnets 1591, 1592, 1601, 1602, 1611, 1612, 1621, 1622.

Referring to FIGS. 44-48, the central sheet portion 1500 is substantially rectangular-shaped. The central sheet portion 1500 has a first side integrally formed with the side sheet portions 1511, 1512, 1513. The central sheet portion 1500 has a second side integrally formed with the side sheet portions 1521, 1522, 1523. The central sheet portion 1500 includes a vertical aperture 1640 (shown in FIG. 48) and horizontal apertures 1651, 1652 extending therethrough. The horizontal apertures 1651, 1652 extend substantially perpendicular to the vertical aperture 1640. The vertical aperture 1640 is provided to receive the support bar 74 (shown in FIG. 47) therein. The horizontal aperture 1651 is provided to receive the support rod 65 (shown in FIG. 47) therein. Also, the horizontal aperture 1652 is provided to receive the support rod 66 therein.

Figure 44:
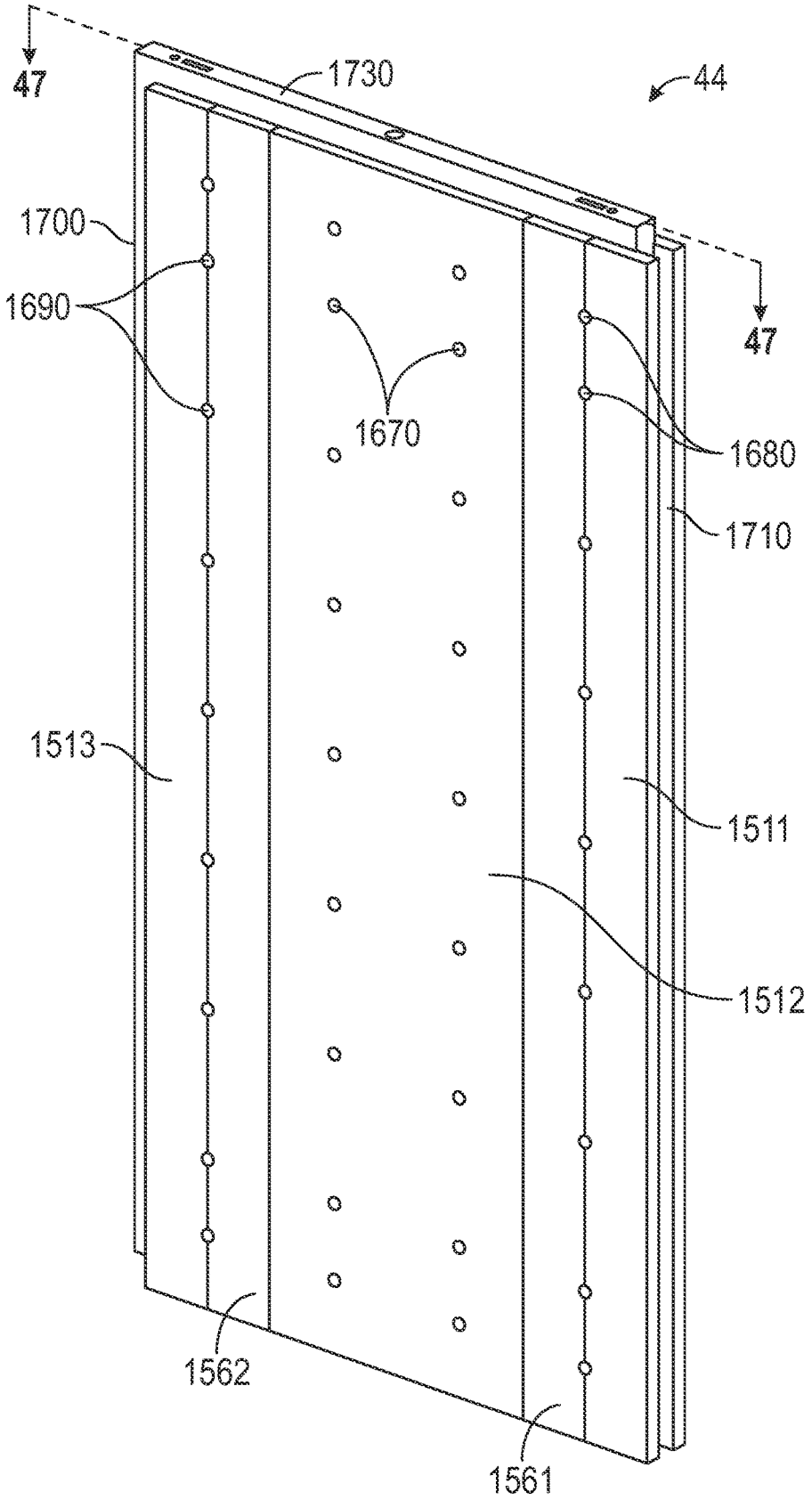
FIG. 44 is an isometric view of a fourth wall member utilized in the wall assembly of FIG. 1.
Figure 46:
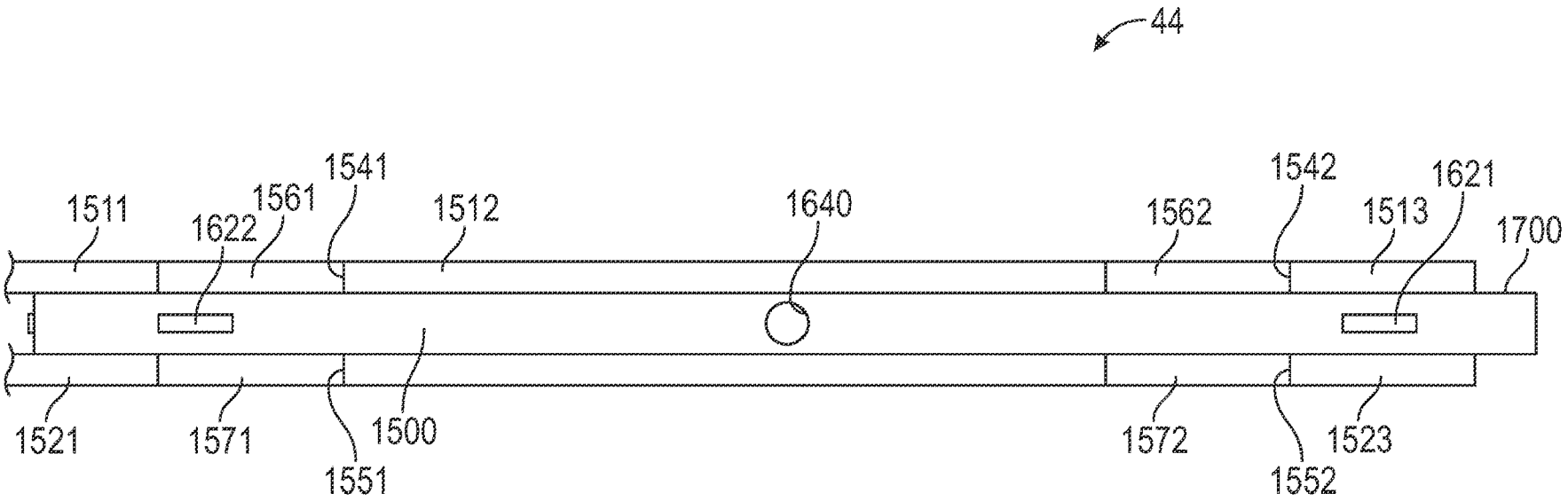
FIG. 46 is a top view of the fourth wall member of FIG. 44.
Figure 48:
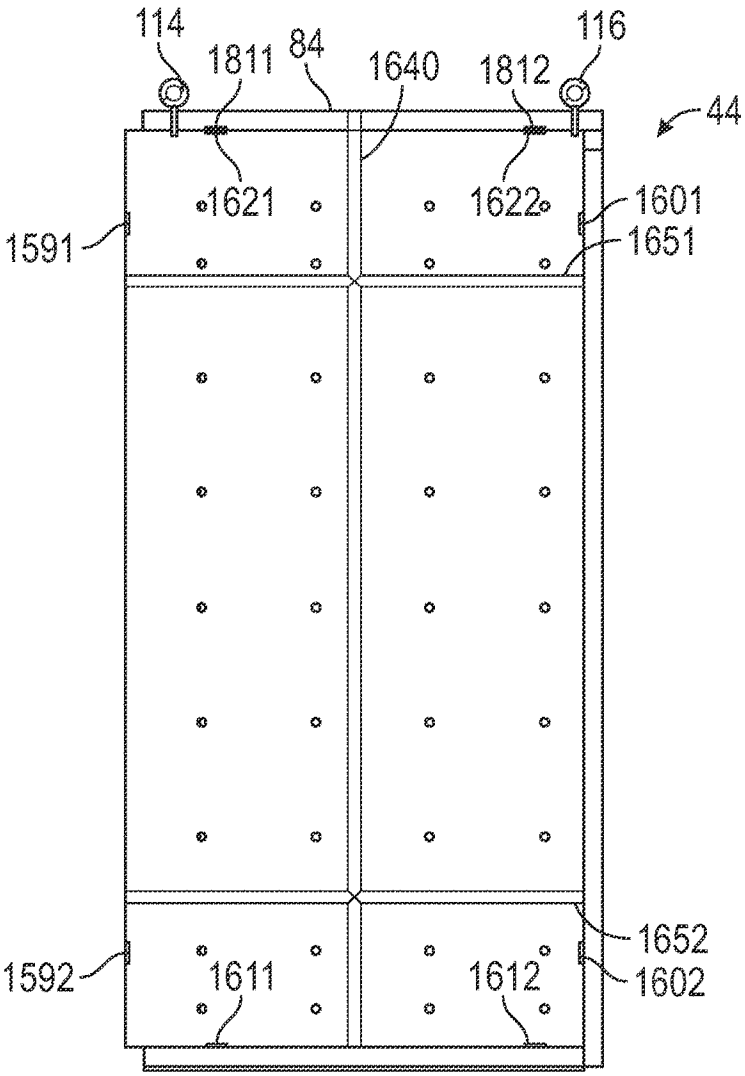
FIG. 48 is another sectional view of the fourth wall member of FIG. 47 when the support bars are removed.

Referring to FIGS. 44 and 46, the central sheet portion 1500 and the side sheet portions 1511, 1512 form the opening 1541 therebetween that receives the attachment board 1561 therein. The central sheet portion 1500 and the side sheet portions 1512, 1513 form the opening 1542 therebetween that receives the attachment board 1562 therein. Also, the central sheet portion 1500 and the side sheet portions 1521, 1522 form the opening 1551 therebetween that receives the attachment board 1571 therein. Further, the central sheet portion 1500 and the side sheet portions 1522, 1523 form the opening 1552 therebetween that receives the attachment board 1572 therein. In an exemplary embodiment, the attachment boards 1561, 1562, 1571, 1572 are glued to the central sheet portion 1500.

Referring to FIGS. 44 and 46, a plurality of apertures 1670 extend through the side sheet portions 1512, 1522 and the central sheet portion 1500. Further, a plurality of apertures 1680 extend through the side sheet portions 1511, 1521, the central sheet portion 1500, and attachment boards 1561, 1571. Also, a plurality of apertures 1690 extend through the side sheet portions 1513, 1523, the central sheet portion 1500, and the attachment boards 1562, 1572.

Figure 45:
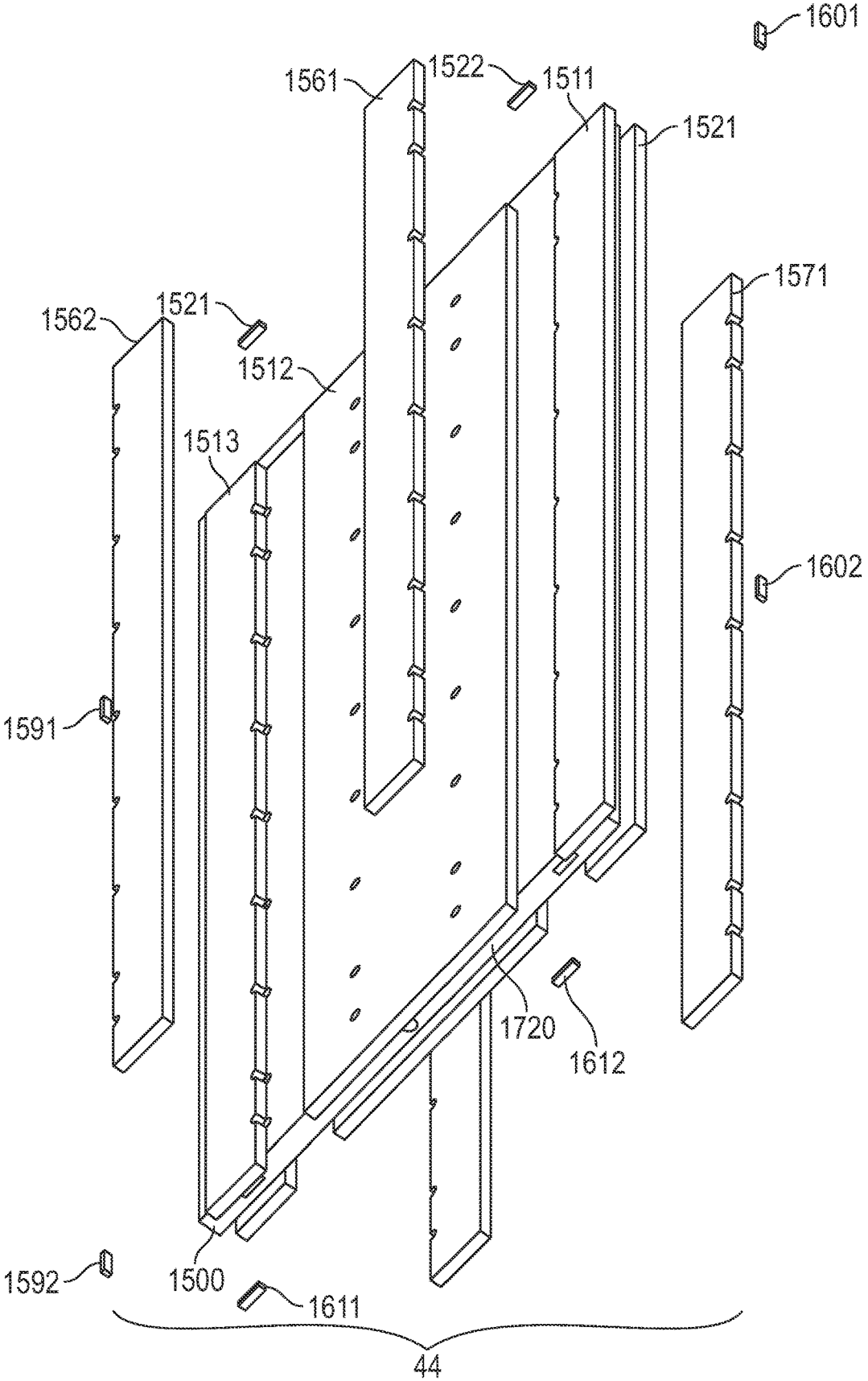
FIG. 45 is an exploded view of the fourth wall member of FIG. 44.

Referring to FIGS. 44-46, a side male coupling portion 1700 is formed from central sheet portion 1500 which extends outwardly past the side sheet portions 1513, 1523. The magnets 1591, 1592 (shown in FIG. 47) are disposed in the side male coupling portion 1700.

A side female coupling portion 1710 is formed from central sheet portion 1500 and the side sheet portions 1511, 1521 which extend outwardly past the central sheet portion 1500. The magnets 1601, 1602 (shown in FIG. 47) are disposed in the side female coupling portion 1710. The side male coupling portion 1700 and the side female coupling portion 1710 extend parallel to one another.

Figure 47:
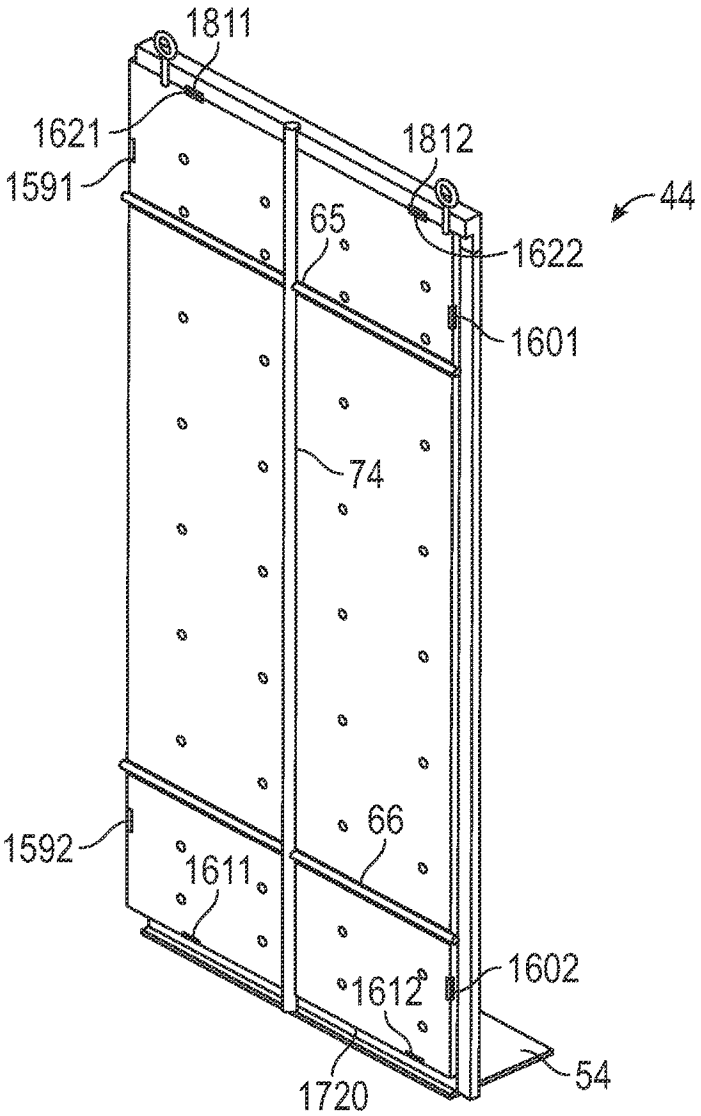
FIG. 47 is a sectional view of the fourth wall member of FIG. 44 taken along lines 47-47 in FIG. 44 when eye bolts, a base member, and support bars are attached thereto.

Referring to FIGS. 45 and 47, a bottom female coupling portion 1720 is formed from central sheet portion 1500 and the side sheet portions 1511, 1512, 1513, and the side sheet portions 1521, 1522, 1523. The side sheet portions 1511, 1512, 1513 and the side sheet portions 1521, 1522, 1523 extend past the central sheet portion 1500. The magnets 1611, 1612 are disposed in the bottom female coupling portion 1720.

Referring to FIGS. 44 and 46, a top male coupling portion 1730 is formed from the central sheet portion 1500 which extends outwardly past the side sheet portions 1511, 1512, 1513 and the side sheet portions 1521, 1522, 1523. The magnets 1621, 1622 are disposed in the top male coupling portion 1730.

In an exemplary embodiment, the central sheet portion 1500, the side sheet portions 1511, 1512, 1513, and the side sheet portions 1521, 1522, 1523 are constructed of a bio-based polyurethane foam. In an alternative embodiment, the central sheet portion 1500, the side sheet portions 1511, 1512, 1513, and the side sheet portions 1521, 1522, 1523 are constructed of expanded polystyrene foam. In an exemplary embodiment, the attachment boards 1561, 1562, 1571, 1572 are constructed of wood. In an alternative embodiment, the attachment boards 1561, 1562, 1571, 1572 are constructed of a plastic wood composite. In yet another alternative embodiment, the attachment boards 1561, 1562, 1571, 1572 are constructed of a fiberglass material.

Fourth Base Member

Figure 49:
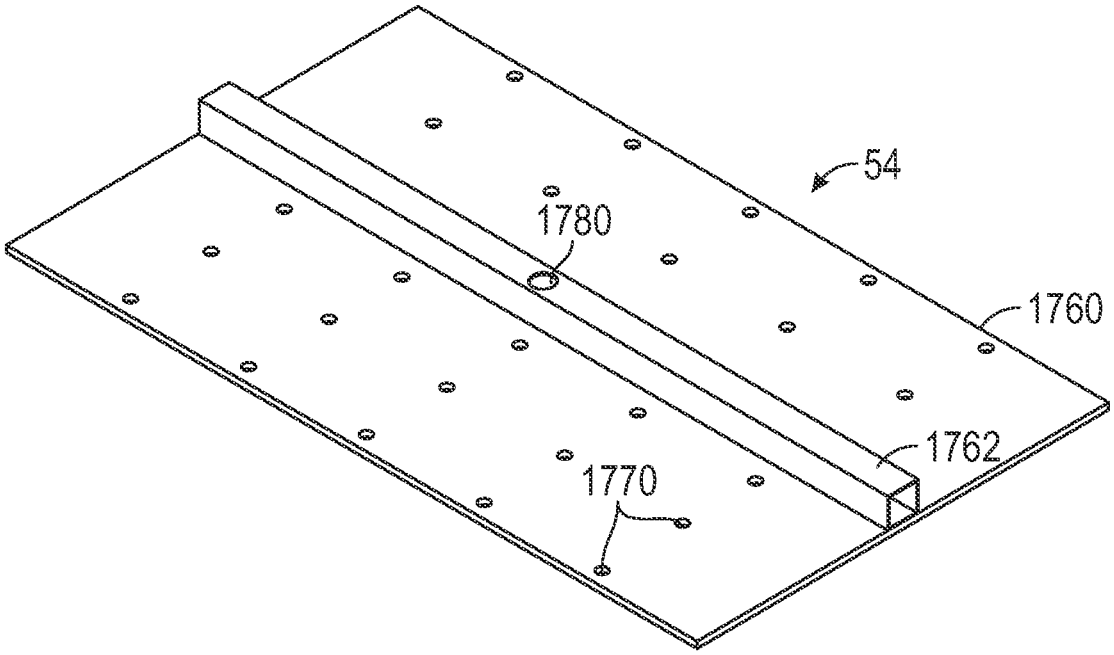
FIG. 49 is an isometric view of a fourth base member utilized in the wall assembly of FIG. 1.

Referring to FIGS. 1 and 49, the fourth base member 54 is provided to removably support and hold the fourth wall member 44 thereon. The fourth base member 54 has a base plate 1760 and a male coupling portion 1762 coupled to and extending upwardly from the base plate 1760. The base plate 1760 is constructed of a metal and includes a plurality of apertures 1770 extending therethrough for mounting the base plate 1760 to a floor. The male coupling portion 1762 is constructed of a rectangular-shaped metal tube and includes an aperture 1780 extending vertically therethrough. The aperture 1780 receives the support bar 74 (shown in FIG. 47) therethrough.

Referring to FIGS. 1, 44, 45 and 49, when the fourth wall member 44 is disposed on the fourth base member 54, the male coupling portion 1762 of the fourth base member 54 is received in the bottom female coupling portion 1720 of the fourth wall member 44. Further, the magnets 1611, 1612 (shown in FIG. 48) of the fourth wall member 44 are magnetically attracted toward the male coupling portion 1762.

Top Cap Member

Figure 50:
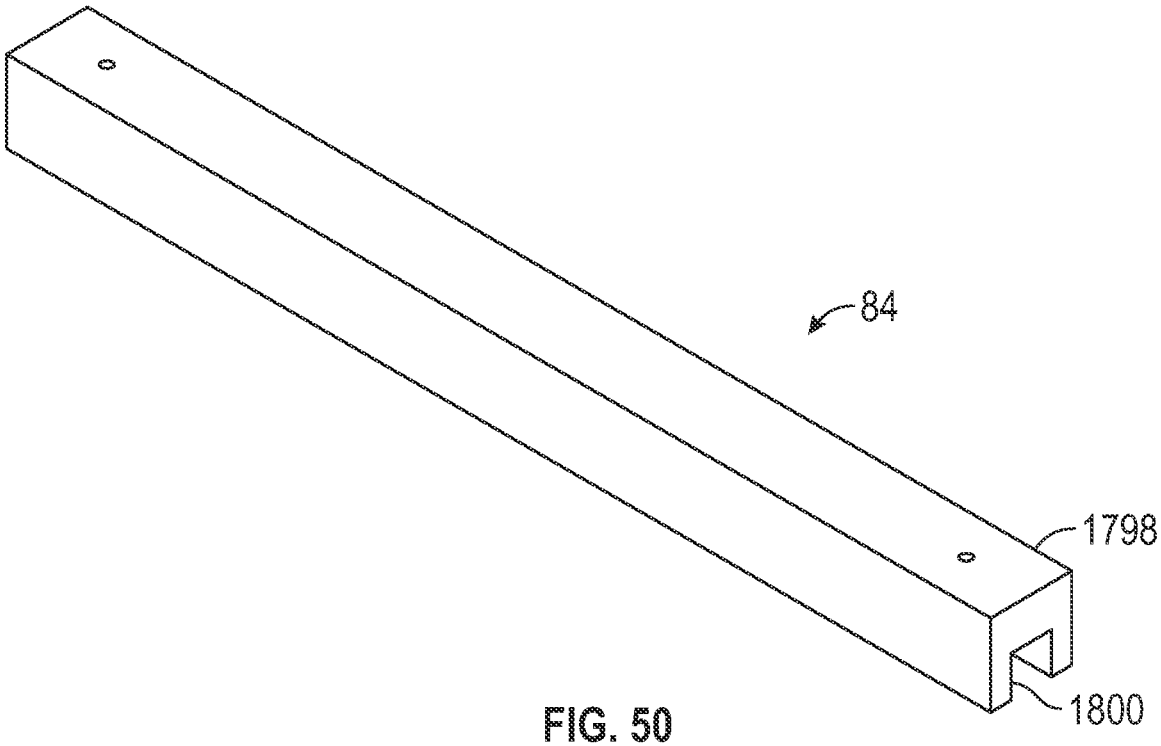
FIG. 50 is an isometric view of another top cap member utilized in the wall assembly of FIG. 1.

Referring to FIGS. 1, 44 and 50, the top cap member 84 is provided to be removably coupled to a side portion of the fourth wall member 44. The top cap member 84 includes a U-shaped body 1798 having a coupling groove 1800 therein. In an exemplary embodiment, the top cap member 84 is constructed of plastic. When top cap member 84 is disposed on the fourth wall member 44, the coupling groove 1800 receives a portion of the top male coupling portion 1730 (shown in FIG. 44) of the fourth wall member 44 therein. In other words, the top male coupling portion 1730 is disposed in the coupling groove 1800.

Corner Coupling Member

Referring to FIGS. 1 and 51-53, the corner coupling member 160 is provided to be removably coupled to and between the first wall member 41 and the fourth wall member 44 and orients the walls 41, 41 substantially 90 degrees relative to one another. The corner coupling member 160 includes a U-shaped inner wall 1850, U-shaped outer walls 1861, 1862, and a magnet 1865. In an exemplary embodiment, the U-shaped inner wall 1850 and the U-shaped outer walls 1861, 1862 are integrally formed to one another and are constructed of plastic.

The U-shaped inner wall 1850 includes wall portions 1871, 1872 which are integrally formed together. The wall portions of 1871, 1872 extend substantially 90 degrees with respect to one another. The magnet 1865 is disposed in the wall portion 1872.

The U-shaped outer wall 1861 includes wall portions 1881, 1882 which are integrally formed together. The wall portions from 1881, 1882 extend substantially 90 degrees with respect to one another. The wall portion 1881 is coupled to a first side of the wall portion 1871. Further, the wall portion of 1882 is coupled to a first side of the wall portion 1872.

The U-shaped outer wall 1862 includes wall portions 1891, 1892 which are integrally formed together. The wall portions 1891, 1892 extend substantially 90 degrees with respect to one another. The wall portion 1891 is coupled to a second side of the wall portion 1871. Further, the wall portion 1892 is coupled to a second side of the wall portion 1872.

A side female coupling portion 1900 is formed from the wall portion 1871 and the wall portions 1881, 1891 which extend outwardly past the wall portion 1871. Also, a side male coupling portion 1910 is formed from the wall portion 1872 which extends outwardly past the wall portions 1882, 1892. Further, a top male coupling portion 1912 (shown in FIG. 51) is formed from the U-shaped inner wall 1850 which extends upwardly past the U-shaped outer walls 1861, 1862.

Figure 51:
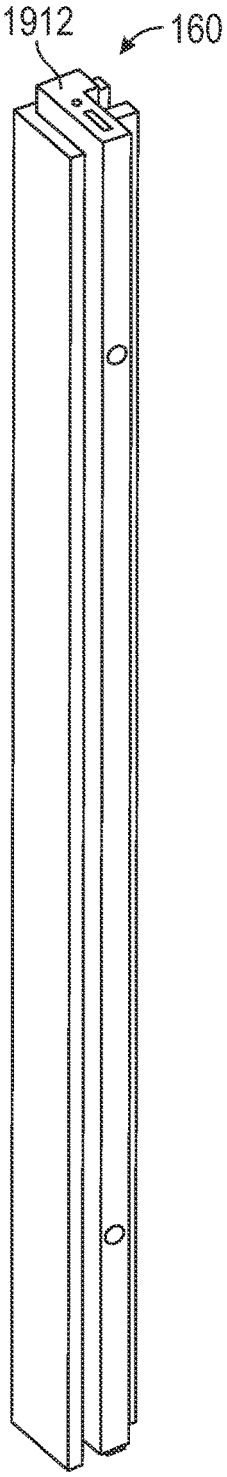
FIG. 51 is an isometric view of another corner coupling member utilized in the wall assembly of FIG. 1.
Figure 52:
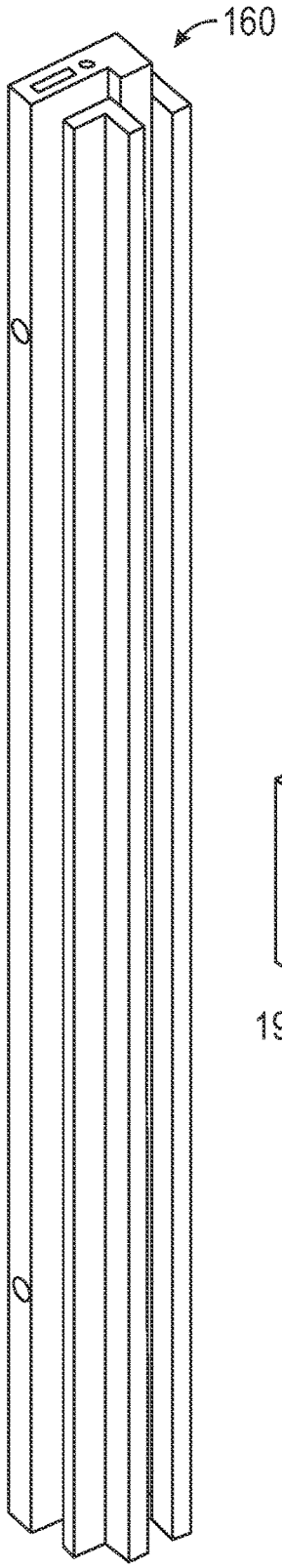
FIG. 52 is another isometric view of the corner coupling member of FIG. 51.
Figure 53:
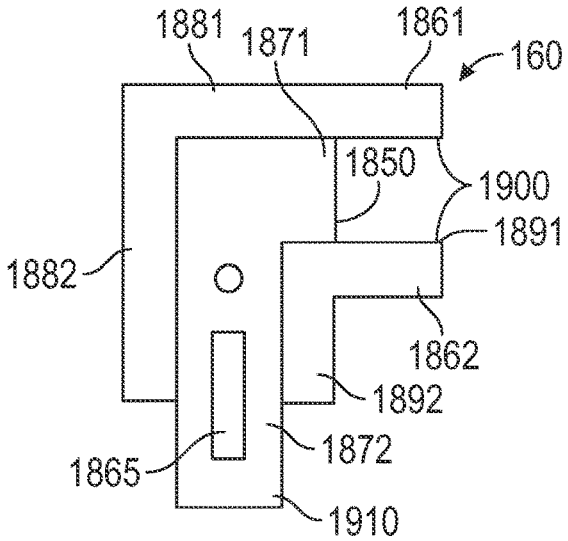
FIG. 53 is a top view of the corner coupling member of FIG. 51.
Figure 54:
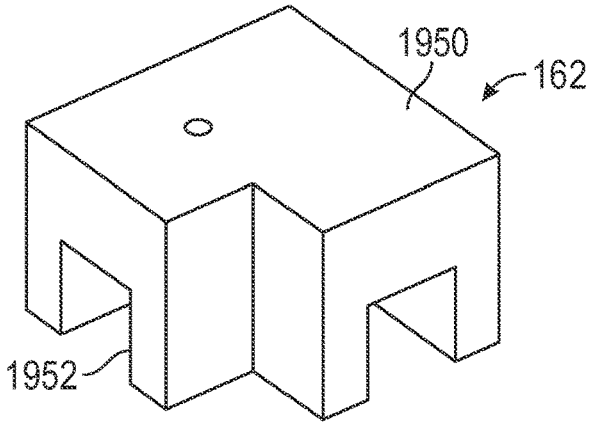
FIG. 54 is an isometric view of another corner cap member utilized in the wall assembly of FIG. 1.
Figure 55:
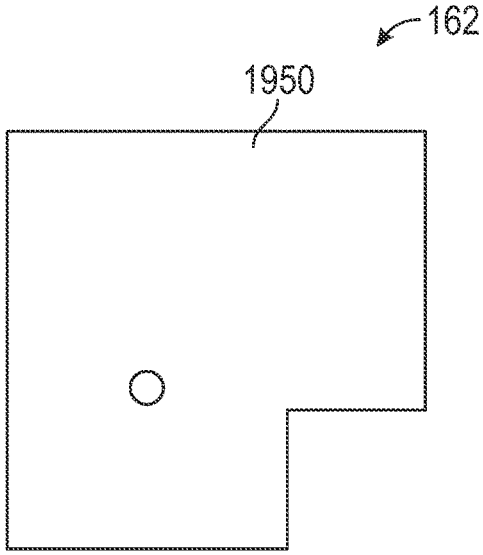
FIG. 55 is a top view of the corner cap member of FIG. 54.
Figure 56:
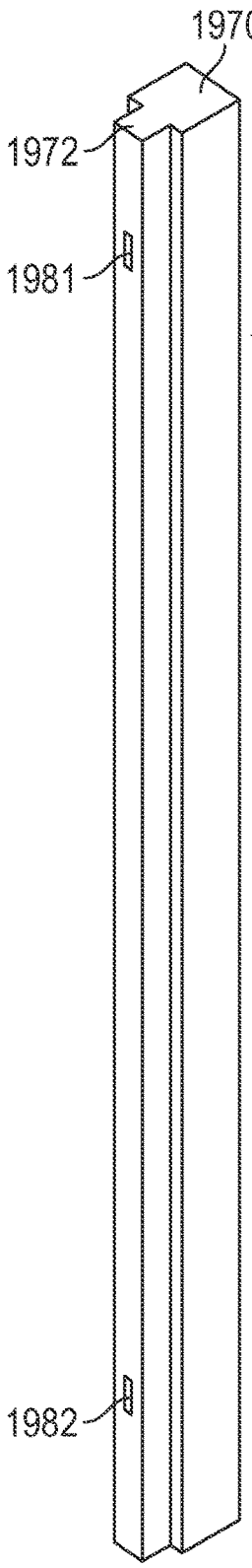
FIG. 56 is an isometric view of another end cap member utilized in the wall assembly of FIG. 1.
Figure 57:
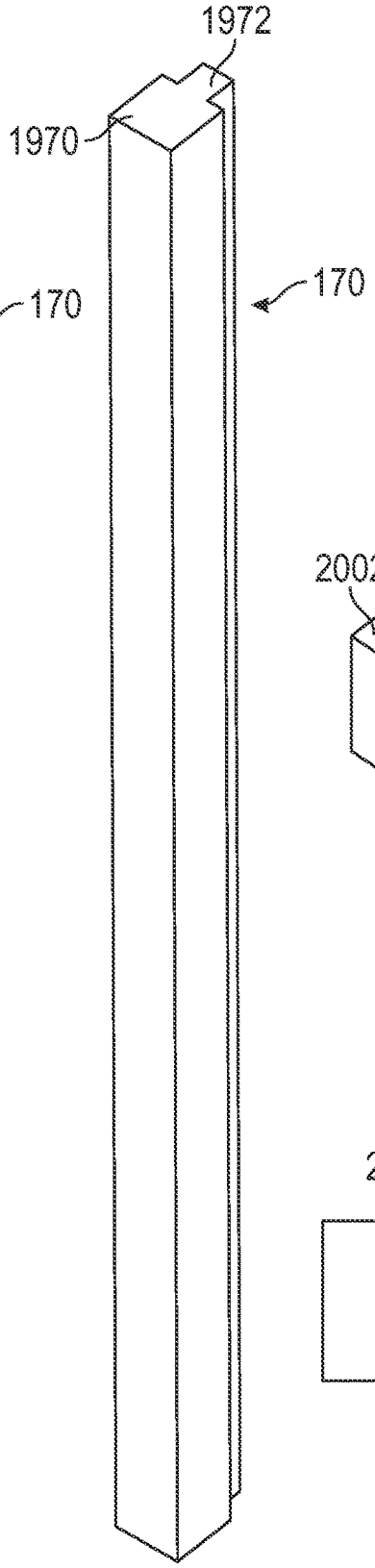
FIG. 57 is another isometric view of the end cap member of FIG. 56.
Figure 58:
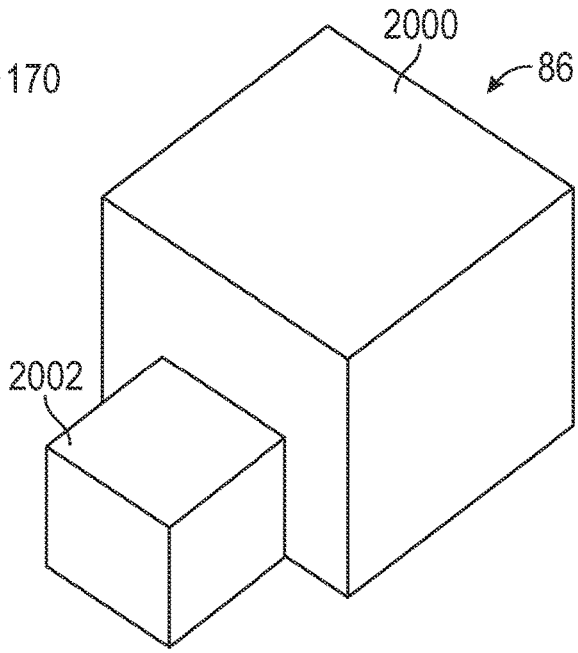
FIG. 58 is an isometric view of another top cap member utilized in the wall assembly of FIG. 1.
Figure 59:
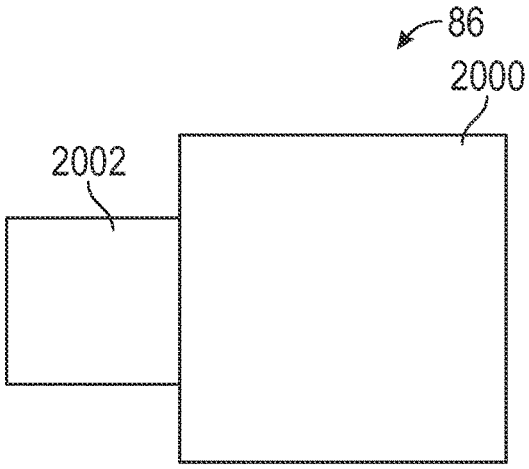
FIG. 59 is a top view of the top cap member of FIG. 58.

Referring to FIGS. 1, 44 and 51, when the corner coupling member 160 is disposed against and coupled to the fourth wall member 44, the side male coupling portion 1700 of the fourth wall member 44 is received in the side female coupling portion 1900 of the corner coupling member 160.

Referring to FIGS. 1, 8 and 51, when the corner coupling member 160 is disposed against and coupled to the first wall member 41, the side male coupling portion 1910 of the corner coupling member 160 is received in the side female coupling portion 410 of the first wall member 41.

Corner Cap Member

Referring to FIGS. 1, 51 and 54-55, the corner cap member 162 is provided to be coupled to a top portion of the corner coupling member 160. The corner cap member 162 has a U-shaped body 1950 with a U-shaped coupling groove 1952. When the corner cap member 162 is disposed on the corner coupling member 160, the U-shaped coupling groove 1952 receives the top male coupling portion 1912 (shown in FIG. 51) of the corner coupling member 160 therein. In other words, the top male coupling portion 1912 is disposed in the coupling groove 1952. In an exemplary embodiment, the corner cap member 162 is constructed of plastic. The eye bolt 118 extends through the corner cap member 162 and into the corner coupling member 160.

End Cap Member

Referring to FIGS. 1, 44 and 56-57, the end cap member 170 is provided to be removably coupled to a side portion of the fourth wall member 44. The end cap member 170 includes a body portion 1970, a side male coupling portion 1972, and magnets 1981, 1982. The side male coupling portion 1972 is integrally formed with the body portion 1970 and extends outwardly from the body portion 1970. In an exemplary embodiment, the body portion 1970 and the side male coupling portion 1972 are constructed of plastic. When the end cap member 170 is disposed on the fourth wall member 44, the side female coupling portion 1710 (shown in FIG. 44) of the fourth wall member 44 receives the side male coupling portion 1972 of the fourth wall member 44 therein. In other words, the side male coupling portion 1972 is disposed in the side female coupling portion 1710. Further, the magnets 1981, 1982 are magnetically attracted toward the magnets 1601, 1602 (shown in FIG. 45), respectively of the fourth wall member 44.

Top Cap Member

Referring to FIGS. 1, 50 and 58-59, the top cap member 86 is provided to be removably coupled to a side portion of the top cap member 84. The top cap member 86 includes a body portion 2000 and a side male coupling portion 2002. The side male coupling portion 2002 is integrally formed with the body portion 2000 and extends outwardly from the body portion 2000. In an exemplary embodiment, the top cap member 86 is constructed of plastic. When top cap member 86 is disposed on the top cap member 84, the coupling groove 1800 (shown in FIG. 50) of the top cap member 84 receives the side male coupling portion 2002 (shown in FIG. 28) of the top cap member 86 therein. In other words, the side male coupling portion 2002 is disposed in the coupling groove 1800.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A wall assembly, comprising:

a first wall member having a side male coupling portion, a side female coupling portion, a bottom female coupling portion, and a first magnet; the side male coupling portion and the side female coupling portion of the first wall member extending parallel to one another, the first magnet of the first wall member being disposed in the side male coupling portion of the first wall member;

a first base member having a base plate and a male coupling portion coupled to and extending upwardly from the base plate thereof;

the bottom female coupling portion of the first wall member receiving the male coupling portion of the first base member therein such that the first wall member is removably coupled to the first base member;

a second wall member having a side male coupling portion, a side female coupling portion, a bottom female coupling portion, and a first magnet; the side male coupling portion and the side female coupling portion of the second wall member extending parallel to one another, the first magnet of the second wall member being disposed in the side female coupling portion of the second wall member;

a second base member having a base plate and a male coupling portion coupled to and extending upwardly from the base plate thereof;

the bottom female coupling portion of the second wall member receiving the male coupling portion of the second base member therein such that the second wall member is removably coupled to the second base member;

the side male coupling portion of the first wall member being received in the side female coupling portion of the second wall member such that the first magnet in the first wall member is magnetically attracted toward the first magnet in the second wall member and the first wall member is removably coupled to the second wall member; and wherein the first wall member further comprises a central sheet portion, first, second, and third side sheet portions integrally formed with a first side of the central sheet portion, and fourth, fifth, and sixth side sheet portions integrally formed with a second side of the central sheet portion, the side male coupling portion of the first wall member being formed from the central sheet portion, the central sheet portion extending outwardly past the third and sixth side sheet portions, the side female coupling portion of the first wall member being formed from the central sheet portion and the first and fourth side sheet portions, the first and fourth side sheet portions extending outwardly past the central sheet portion, and the bottom female coupling portion of the first wall member being formed from the central sheet portion and the first, second, third, fourth, fifth, and sixth side sheet portions, the first, second, third, fourth, fifth, and sixth side sheet portions extending downwardly past the central sheet portion.

2. The wall assembly of claim 1, further comprising:

a first support bar;

the first wall member having a horizontal aperture extending therethrough;

the second wall member having a horizontal aperture extending therethrough; and the first support bar being received through the horizontal aperture of the first wall member and the horizontal aperture of the second wall member to removably couple the first wall member of the second wall member.

3. The wall assembly of claim 1, further comprising:

a first support bar;

the first wall member having a first vertical aperture extending therethrough;

the male coupling portion of the first base member having an aperture extending therethrough; and the first support bar being received through the first vertical aperture of the first wall member and the aperture of the first base member to removably couple the first wall member to the first base member.

4. The wall assembly of claim 1, further comprising:

a first top cap member having a coupling groove and a first magnet disposed therein;

the first wall member having a top male coupling portion and a second magnet disposed therein; the top male coupling portion of the first wall member extending parallel to the bottom female coupling portion of the first wall member; and the top male coupling portion of the first wall member being disposed in the coupling groove of the first top cap member such that the first magnet in the first top cap member is magnetically attracted to the second magnet of the first wall member such that the first top cap member is removably coupled to the first wall member.

5. The wall assembly of claim 4, further comprising:

an eye bolt being coupled to the first top cap member.

6. The wall assembly of claim 1, wherein:

the first base member is a metal base member; and the bottom female coupling portion of the first wall member having a second magnet therein such that the second magnet in the first wall member is magnetically attracted toward the first base member.

7. The wall assembly of claim 1, further comprising:

a corner coupling member having a side male coupling portion and a side female coupling portion;

a third wall member having a side male coupling portion, a side female coupling portion, a bottom female coupling portion, and a first magnet; the side male coupling portion and the side female coupling portion of the third wall member extending parallel to one another, the first magnet of the third wall member being disposed in the side female coupling portion of the third wall member;

a third base member having a base plate and a male coupling portion coupled to and extending upwardly from the base plate thereof;

the bottom female coupling portion of the third wall member receiving the male coupling portion of the third base member therein such that the third wall member is removably coupled to the third base member;

the side female coupling portion of the corner coupling member receiving the side male coupling portion of the second wall member therein to removably couple the corner coupling member to the second wall member; and the side male coupling portion of the corner coupling member being received in the side female coupling portion of the third wall member to removably couple the corner coupling member to the third wall member.

8. The wall assembly of claim 7, further comprising:

a corner cap member having a coupling groove therein; and the corner coupling member having a top male coupling portion that is disposed in the coupling groove of the corner cap member to removably couple the corner cap member to the corner coupling member.

9. The wall assembly of claim 7, further comprising:

a side end cap member having a coupling groove therein;

the side male coupling member of the third wall member being received in the coupling groove of the side end cap member to removably couple the side end cap member to the third wall member.

10. The wall assembly of claim 7, wherein:

the corner coupling member orients the second and third wall members at 135 degrees relative to another.

11. The wall assembly of claim 7, wherein:

the corner coupling member orients the second and third wall members at 90 degrees relative to another.

* * * * *